US007380296B2

(12) United States Patent
Ellen et al.

(10) Patent No.: US 7,380,296 B2
(45) **Date of Patent: *Jun. 3, 2008**

(54) RESTRAINING ENCLOSURE FOR A BED AND RELATED METHOD

(75) Inventors: Thomas D. Ellen, North Granby, CT (US); John J. Gildea, Bondville, VT (US)

(73) Assignee: Vival Medical Corporation, Torrington, CT (US)

( * ) Notice: Subject to any disclaimer, the term of this patent is extended or adjusted under 35 U.S.C. 154(b) by 16 days.

This patent is subject to a terminal disclaimer.

(21) Appl. No.: 10/910,939

(22) Filed: Aug. 3, 2004

(65) Prior Publication Data

US 2005/0011006 A1 Jan. 20, 2005

Related U.S. Application Data

(63) Continuation-in-part of application No. 10/294,313, filed on Nov. 14, 2002, now Pat. No. 6,772,458.

(60) Provisional application No. 60/332,750, filed on Nov. 14, 2001.

(51) Int. Cl.
*A47C 21/08* (2006.01)

(52) U.S. Cl. ..... 5/424; 5/98.1; 135/156; 135/96

(58) Field of Classification Search ..... 5/424, 5/97, 414, 508, 98.1, 4, 1, 658; 135/96, 157, 135/143, 151, 156, 901; 160/237, DIG. 7
See application file for complete search history.

(56) References Cited

U.S. PATENT DOCUMENTS 875,206 A 12/1907 Osborne
1,410,830 A 3/1922 O'Neal
1,526,038 A 2/1925 Allman
2,850,027 A 9/1958 Smith
3,051,164 A 8/1962 Trexler
3,119,358 A 1/1964 Colson et al.
3,265,059 A 8/1966 Matthews
3,272,199 A 9/1966 Matthews
3,345,996 A 10/1967 Sadove et al.
3,348,890 A 10/1967 Trexler
3,492,987 A 2/1970 Parker
3,501,213 A 3/1970 Trexler
3,505,989 A 4/1970 Truhan
3,601,031 A 8/1971 Abel et al.
3,709,210 A 1/1973 Matthews
3,802,416 A 4/1974 Cazalis
4,026,286 A 5/1977 Trexler
4,335,712 A 6/1982 Trexler (Continued)

*Primary Examiner*—Alexander Grosz
(74) *Attorney, Agent, or Firm*—McCarter & English, LLP

(57) ABSTRACT

A collapsible enclosure for restraining a patient to an area about a bed comprises a frame having a horizontal eave portion, a horizontal base portion opposing the horizontal eave portion, and at least two vertical members upstanding from the horizontal base portion for supporting the horizontal eave portion. The frame collapses as an integral unit for storage and transfer. A canopy secured to the frame defines an area about a bed such that a patient is allowed to move freely within the area. The canopy includes see-through portions defined by dark colored mesh to enhance visibility therethrough and prevent glare. In one embodiment, the canopy includes a hermetically sealable chamber defining the patient area for quarantining the patient therein.

23 Claims, 21 Drawing Sheets

U.S. PATENT DOCUMENTS

| | | | | |
|---|---|---|---|---|
| 4,641,387 | A | 2/1987 | Bondy et al. | |
| 4,731,961 | A | 3/1988 | Bona | |
| 5,216,291 | A | 6/1993 | Seevinck et al. | |
| 5,314,377 | A | 5/1994 | Pelosi, III | |
| 5,384,925 | A | 1/1995 | Vail | |
| 5,771,651 | A | 6/1998 | Shiina | |
| 6,125,483 | A | 10/2000 | Stroud et al. | |
| 6,216,291 | B1 | 4/2001 | Eads et al. | |
| 6,263,529 | B1 | 7/2001 | Chadwick et al. | |
| 6,321,764 | B1 | 11/2001 | Gauger et al. | |
| 6,461,290 | B1 | 10/2002 | Reichman et al. | |
| 6,487,735 | B1 * | 12/2002 | Jacques et al. | 5/424 |

* cited by examiner

RESTRAINING ENCLOSURE FOR A BED AND RELATED METHOD

This patent application is a Continuation-In-Part (CIP) of U.S. patent application Ser. No. 10/294,313 filed Nov. 14, 2002, now U.S. Pat. No. 6,772,458, which claims priority to U.S. Provisional Patent Application No. 60/332,750, filed Nov. 14, 2001, the entire disclosures of which are hereby incorporated by reference.

BACKGROUND OF THE INVENTION

1. Field of the Invention

The subject invention relates to systems for providing a restraining enclosure for patients for whom it is desirable to restrain or isolate to a bed area.

2. Background of the Related Art

Various illnesses and conditions such as brain trauma, dementia and Alzheimer's disease often leave people in such a condition that constant management of the patient is necessary to prevent further injury and mishap. Traditional systems and methods for monitoring and controlling patients with such needs have included bed straps or restraints, straight jackets, sedation, a monitoring device, a dedicated individual at hand, isolation rooms and the like both alone and in combination. Many of these prior art methods and systems are burdensome to all concerned and prohibitively expensive. For example, bed straps immobilize a patient on a bed. When the patient desires to move or change position, the restraints prevent such shifting. As a result, a restrained patient can become very uncomfortable and/or agitated in addition to suffering medical complications. For another example, a dedicated person to attend to the restrained person's needs on an all day, every day basis is cost prohibitive.

Recently, several techniques for addressing confining a patient to a bed area while allowing free movement have been developed to address the needs of the patient and caregiver. Some examples are illustrated in U.S. Pat. No. 5,216,291 to Eads et al. and U.S. Pat. No. 6,263,529 to Chadwick et al., each of which is incorporated herein by reference. However, there are problems associated with the prior art enclosure bed apparatus. Often, the condition which requires restraint may be temporary and as a result transportation, assembly and disassembly of the enclosure may be common. The prior art systems require extensive manpower for assembly and disassembly. When disassembled, loose parts can be lost and transport and storage is cumbersome and difficult. To assemble, tools and excessive know-how and manpower are needed. When assembled, excessive bulk prevents easy transport and storage.

There is a need, therefore, for an improved system which permits easy assembly, disassembly, storage and transport and aids in assuring adequate restraint and monitoring of patients.

SUMMARY OF THE INVENTION

In accordance with one aspect, the present invention is directed to a collapsible isolation enclosure for restraining a patient to an area about a bed, including a frame having a horizontal eave portion, a horizontal base portion opposing the horizontal eave portion and at least two vertical members upstanding from the horizontal base portion for supporting the horizontal eave portion, wherein for storage and transport the frame collapses as an integral unit. A canopy assembly secures to the frame for defining an area about a bed such that the patient is allowed to move freely within the area.

In a preferred embodiment of the present invention, the enclosure for restraining a patient to an area about a bed is suitable to operate as a portable quarantine or isolation unit including a frame for surrounding a bed, a frame that is fixedly secured to the bed, or a frame and bed assembly wherein the frame is mounted on the bed. The frame has an upper laterally extending support and first and second upstanding supports for supporting the upper laterally extending support. In one such embodiment, the frame folds compactly for transport and storage. A canopy assembly is secured to the frame for defining an area about the bed such that a patient is allowed to move freely within the area.

In accordance with another aspect, the present invention is directed to an enclosure for restraining a person to an area about a bed, wherein the bed is adapted to support the person. The enclosure comprises a frame adapted to surround the bed. The frame includes an upper laterally extending support; a first upstanding support coupled to a first side of the upper laterally extending support; and a second upstanding support coupled to a second side of the upper laterally extending support. A canopy of the enclosure is connectable to the frame for defining an area about the bed such that a person is allowed to move freely within the area. The canopy includes least one access portion that is movable between a closed position and an open position defining an opening through the canopy for allowing access to the person area. The canopy further includes least one see-through portion defined by a dark-colored mesh for permitting visual monitoring of the person area from outside of the canopy and preventing glare.

In accordance with another aspect, the present invention is directed to an enclosure for restraining a person to an area about a bed, wherein the bed is adapted to support the person. The enclosure comprises a frame adapted to surround the bed. The frame includes an upper laterally extending support; a first upstanding support coupled to a first side of the upper laterally extending support; and a second upstanding support coupled to a second side of the upper laterally extending support. At least one of the first upstanding support, the second upstanding support and the upper laterally extending support is movable relative to at least one of the other supports for folding the frame for transport or storage. The enclosure further includes a canopy connectable to the frame. The canopy includes a hermetically sealable chamber about the bed and within which the person is allowed to move freely. The canopy further includes at least one access portion movable between a closed position and an open position defining an opening through the canopy for allowing access to the hermetically sealable chamber. At least one see-through portion of the canopy permits visual monitoring of the hermetically sealable chamber from outside of the canopy.

In accordance with another aspect, the present invention is directed to a method for restraining a person to an area about a bed adapted to support the person. The method comprises the steps of:

(1) providing a removable and collapsible frame including an upper support and a plurality of upstanding supports coupled to the upper support, wherein at least one of the upper supports and upstanding supports is movable relative to at least one of the other supports for folding the frame into a collapsed condition and unfolding the frame into an open condition;

(2) positioning the collapsible frame in an open condition;

(3) surrounding the bed with a canopy supported on the frame and defining an area within the canopy and about the bed within which the person is allowed to move freely;

(4) allowing access to the person through a portion of the canopy that is movable between an open and a closed position; and (5) allowing visual monitoring of the person from outside of the canopy through a see-through portion of the canopy.

In accordance with one embodiment of the present invention, the method further comprises the step of collapsing the frame by pivoting at least a portion of the upper support inwardly toward at least one of the upstanding supports. In accordance with another embodiment, the method further comprises the step of hermetically sealing the person area within the canopy to substantially prevent contamination within said area from passing out of said area. In accordance with another embodiment, the method further comprises allowing visual monitoring of the person from outside of the canopy through a see-through portion of the canopy and preventing glare within the see-through portion by providing same with a dark-colored mesh.

Accordingly, an advantage of one aspect of the present invention is found in an enclosure that is easily assembled, disassembled, transported, stored and cleaned.

Another advantage of the present invention is found in the ability to safely restrain a patient to an area while still allowing for free and comfortable movement within the area.

Still another advantage of the present invention is found in a restraining enclosure that permits effective visual monitoring of a patient within the area of retention.

Yet still another advantage of the present invention is found in it flexibility in application. Accordingly, it should be appreciated that the present invention can be implemented and utilized in numerous ways, including without limitation as a process, an apparatus, a system, a device and a method for applications now known and later developed. These and other unique features of the apparatus and method disclosed herein will become more readily apparent from the following description and the accompanying drawings.

BRIEF DESCRIPTION OF THE DRAWINGS

So that those having ordinary skill in the art to which the disclosed invention appertains will more readily understand how to make and use the same, reference may be had to the drawings wherein.

DETAILED DESCRIPTION OF THE PREFERRED EMBODIMENTS

Figure 1:
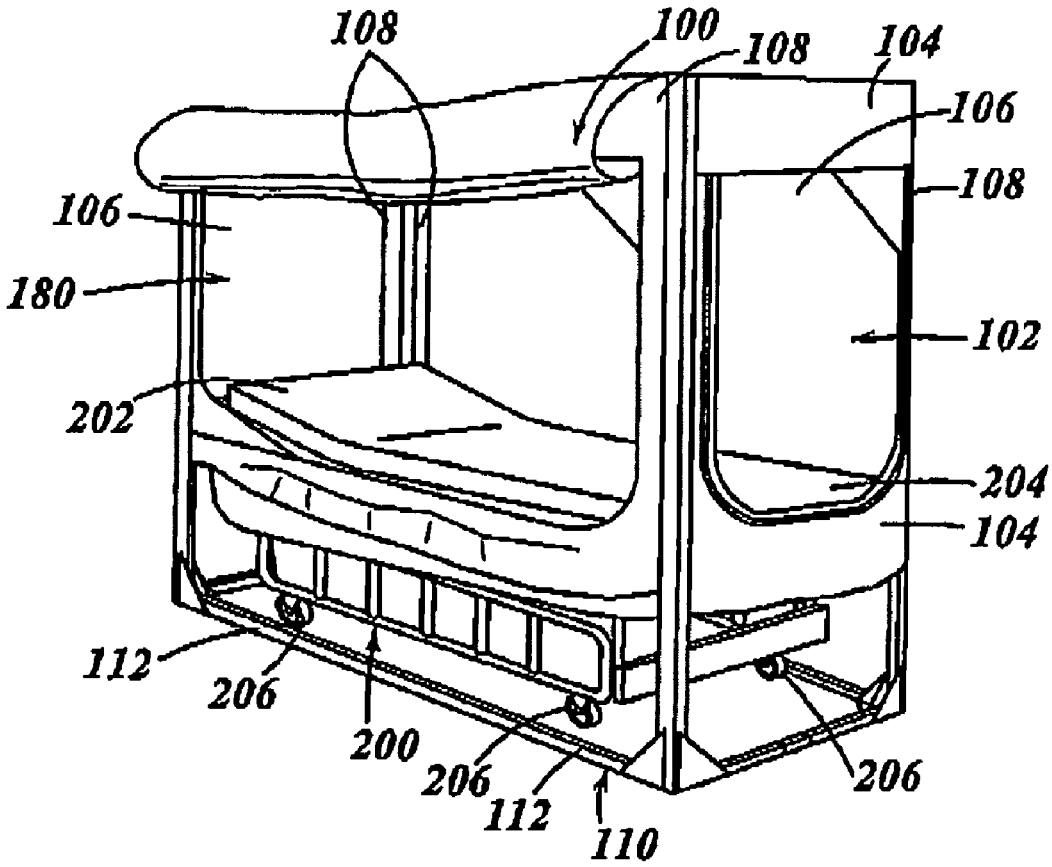
FIG. 1 illustrates a collapsible patient restraining enclosure for a bed constructed in accordance with present invention, and in particular the restraining enclosure positioned about a bed.

The present invention overcomes many of the prior art problems associated with enclosures for restraining patients to a bed area. The advantages, and other features of the system disclosed herein, will become more readily apparent to those having ordinary skill in the art from the following detailed description of certain preferred embodiments taken in conjunction with the drawings which set forth representative embodiments of the present invention and wherein like reference numerals identify similar structural elements.

The subject enclosure safely confines a patient to an area defined around a bed. However, the patient is free to move within the area about the bed. Caregivers and attendants can see into the restrained area as well as access the patient through selectively fastenable openings. The patient has the ability to see and interact with the general environment around the enclosure. In the illustrated embodiments, when not in use, the enclosure can be collapsed for easy storage and transport. However, as will be recognized by those of ordinary skill in the pertinent art based on the teachings herein, the canopy of the present invention is equally usable with frames that are not collapsible, and/or frames that are mountable on the bed frame, or otherwise fixedly securable to the bed frame.

Referring to FIG. 1, a collapsible enclosure 100 confines a person to their bed 200 without restraints. Typically, the enclosure 100 would be used in a hospital environment with a standard hospital bed 200. The enclosure 100 has a unitary aluminum frame 110 which defines an area of restraint about the bed 200. It is envisioned that the frame 110 can be fabricated from a variety of materials now known and later developed such as steel, PVC pipe, aluminum, plastics, carbon fiber composite, other metals and the like, alone or in combination, to create a suitably robust and lightweight frame 110. In one embodiment, and as shown typically in FIG. 5A, the frame 110 has casters for moving the frame 110.

A canopy 102 is draped about the frame 110 and secured in place to prevent a person from leaving the area of restraint. The canopy 102 leaves access to a portion of the bed 200 for adjustment thereto. The canopy 102 can be secured in place on or over the frame 110 by zippers, fabric sleeves which slide over the frame components, Velcro™ and the like, or combinations thereof as would be appreciated by those of ordinary skill in the art based upon review of the subject disclosure. Zippers 108 allow movement of portions of the canopy 102 to allow access to the area of retention. Preferably, all of the zippers used on canopy 102 are self-locking.

In one embodiment, the canopy 102 drapes on the inside of the frame. Preferably, the canopy 102 is fabricated from a combination of vinyl or nylon portions 104 and netting 106. In a preferred embodiment, the netting 106 is black nylon netting. The advantage of the black color as well as brown, blue and the like is that dark colors allow for improved see-through capability and greater stain resistance. Further, nylon material is substantially lighter than vinyl and therefore easier to handle.

Figure 2A:
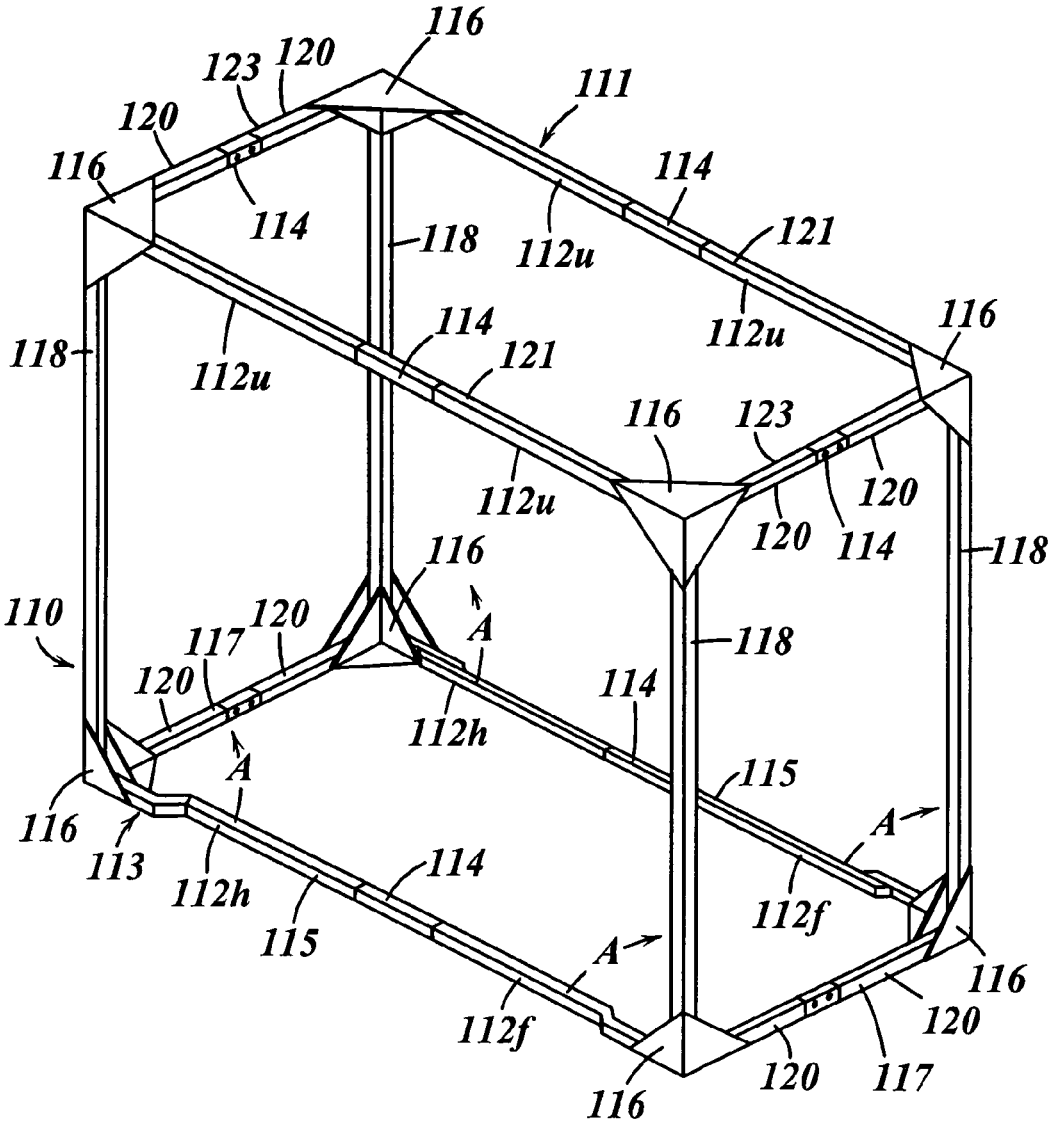
FIG. 2A is a perspective view of an assembled frame of the restraining enclosure of FIG. 1.
Figure 2B:
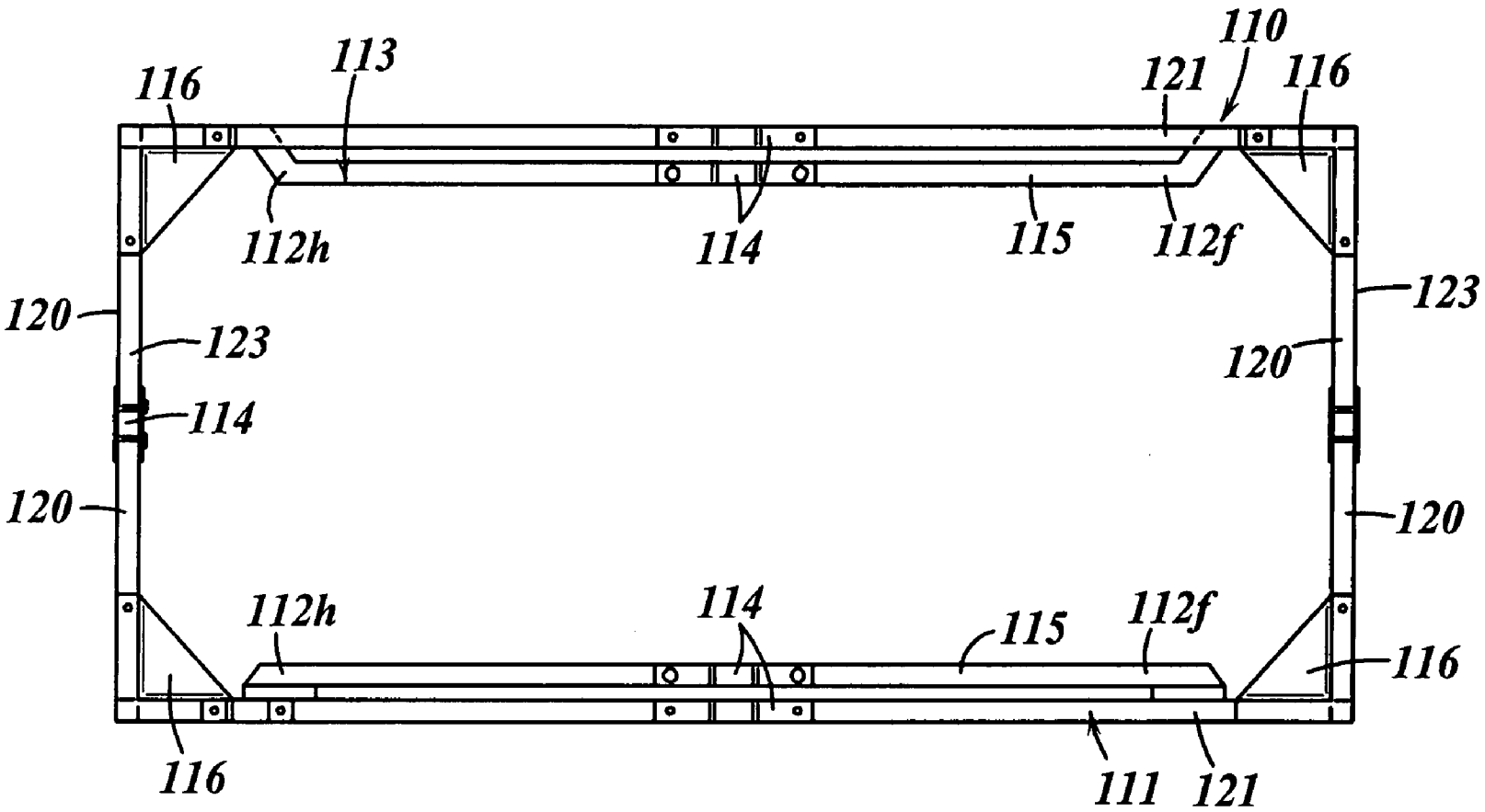
FIG. 2B is a bottom plan view of the assembled frame of FIG. 1.

Now referring to FIGS. 2A and 2B, the frame 110 includes an eave portion 111 supported above a base portion 113 by four vertical bars 118. When assembled, the frame 110 is rigid and supported on the floor by the base portion 113. The bed 200 within the enclosure 100 has a head 202 and a foot 204 (see FIG. 1); thus, the frame 110 has a corresponding head end and foot end, respectively, although the frame 110 as shown is symmetrical. Preferably, the strength and stability of the frame 110 is such that an adult could robustly attempt exit without damage to the frame 110 or tipping the frame 110 over.

As shown in FIG. 2A, the base portion 113 has two non-linear substantially parallel elongated supports 115, each support 115 having a head portion 112*h* and a foot portion 112*f*. The head portion 112*h* and the foot portion 112*f* are linked by a coupling 114. Two parallel transverse supports 117 extend between the non-linear supports 115 to substantially form a rectangle approximately the size of a standard hospital bed 200. The transverse supports 117 include two portions 120 linked by a coupling 114. Traditionally, the standard hospital bed 200 is approximately 90.25.times.36.64 inches, although it will be appreciated that the enclosure 100, in particular the rectangle formed by the base portion 113 and eave portion 111, is well suited to adaptation to beds of any size.

Four lower corner brackets 116 secure the elongated supports 115 and transverse supports 117 of the base portion 113 in such a manner that both supports 115, 117 can selectively rotate. Preferably, each coupling 114 is pivotably connected and located intermediate each support 115, 117 for facilitating collapsing the frame 110 as will be described hereinbelow with respect to FIGS. 4 and 5. The central region of each elongated support 115 of the base portion 113 is offset towards the interior of the enclosure 100 for facilitating collapsing the enclosure 100 as well.

The eave portion 111 is supported above the base portion 113 by four vertical, parallel rectangular bars 118. Two linear parallel elongated supports 121 extend between a head end and a foot end of the eave portion 111. Two parallel transverse supports 123 extend between the elongated supports 121 to form a rectangle therewith approximately the size of a standard hospital bed 200. Four upper corner brackets 116 secure the supports 121, 123 of the eave portion 111 in such a manner that each of the supports can selectively rotate downward therefrom. Preferably, each of the supports 121, 123 of the eave portion 111 has pivot devices or couplings 114 located intermediate their length for facilitating collapsing the frame 110.

Still referring to FIGS. 2A and 2B, when assembled, the corner brackets 116 rigidly secure the four vertical bars 118 thereto. In another embodiment, the four vertical bars 118 are integral with the corner brackets 116. In another embodiment, the supports 121, 123 of the eave portion 111 are monolithic and selectively detach from the corner brackets 116 for partial disassembly. In still another embodiment, the head end and the foot end of the eave portion 111 are supported above the base portion 113 by two solid panels as would be appreciated by those of ordinary skill in the pertinent art based upon review of the subject disclosure, and shown in phantom lines on FIG. 4. In yet still another embodiment, only elongated or transverse parallel pairs of parallel supports of the eave and base portions include pivoting couplings 114, thus the frame only partially collapses.

In order to position the bed 200 within the enclosure 100, the head end 112*h* and the foot end 112*f* of the base portion can be disconnected at an intermediate point via coupling 114 and rotated upwards along arrow A (FIG. 2A). Since the bed 200 is commonly mounted on wheels 206, the bed 200 can be rolled into the enclosure 100 without interference. Upon positioning the bed 200 within the enclosure 100, the head end 112*h* and the foot end 112*f* are rotated downwards and secured together with coupling 114. At such time, a mattress is placed inside the canopy 102 and the patient may be placed in the bed 200 and the canopy 102 secured in place. Alternatively, the canopy 102 may be secured in place about the frame 110 and the patient may enter the restraining area through an opening 180 in the canopy 102 (FIG. 1). In another embodiment, there is no base portion. In one such embodiment without a base portion, the four vertical bars 118 would terminate in foot plates. In another embodiment, the four vertical bars 118 terminate in a post adapted and configured for insertion in the headboard and footboard slots of a standard hospital bed 200. Thus, to erect the enclosure about the bed 200, the headboard and footboard are removed and the four vertical bars are inserted therein. Alternatively, the four vertical bars could bolt onto a bed or an adapter plate could facilitate secure locking engagement to a bed.

Referring to FIGS. 3A through 3D, a corner bracket 116 has a base component 140 and an upper component 142 which are preferably made from metal and welded or riveted together. The base component 140 has a substantially triangular platform 148 with two upstanding triangles 149 on edges thereof. The two upstanding triangles 149 define a channel 151 for receiving a portion of a vertical bar 118. The upper component 142 has a flange 143 for engaging the base component 140 and two upstanding triangles 145. As shown typically in FIG. 3D, the vertical bars 118 are also welded, riveted or otherwise fixed securely to the corner brackets 116. An angle iron 144 (FIG. 3D) is welded or riveted to the upper component 142 and vertical bar 118 for additional support, fit and rigidity. It is envisioned that the vertical bars 118, base component 140, upper component 142 and angle iron 144 may be of monolithic construction, riveted, screwed, glued or the like, in order to form a desired shape which performs the necessary function. In another embodiment, instead of an angle iron 144 for extra structural support, the shape of the corner brackets 116 is modified to conform to the vertical bar 118 for fixedly securing the vertical bar 118 thereto.

Figure 3A:
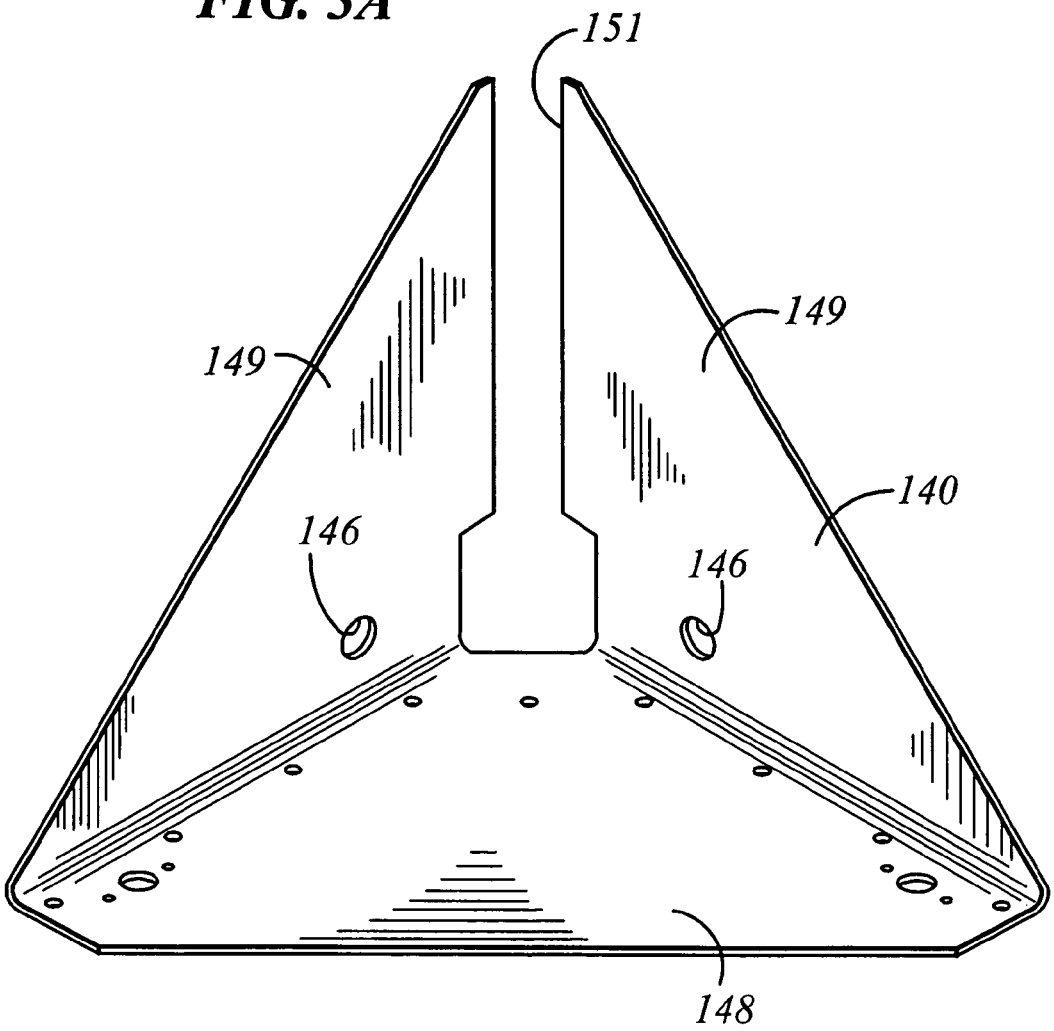
FIG. 3A is a perspective view of an outer portion of a corner bracket of the frame of FIG. 1.
Figure 3B:
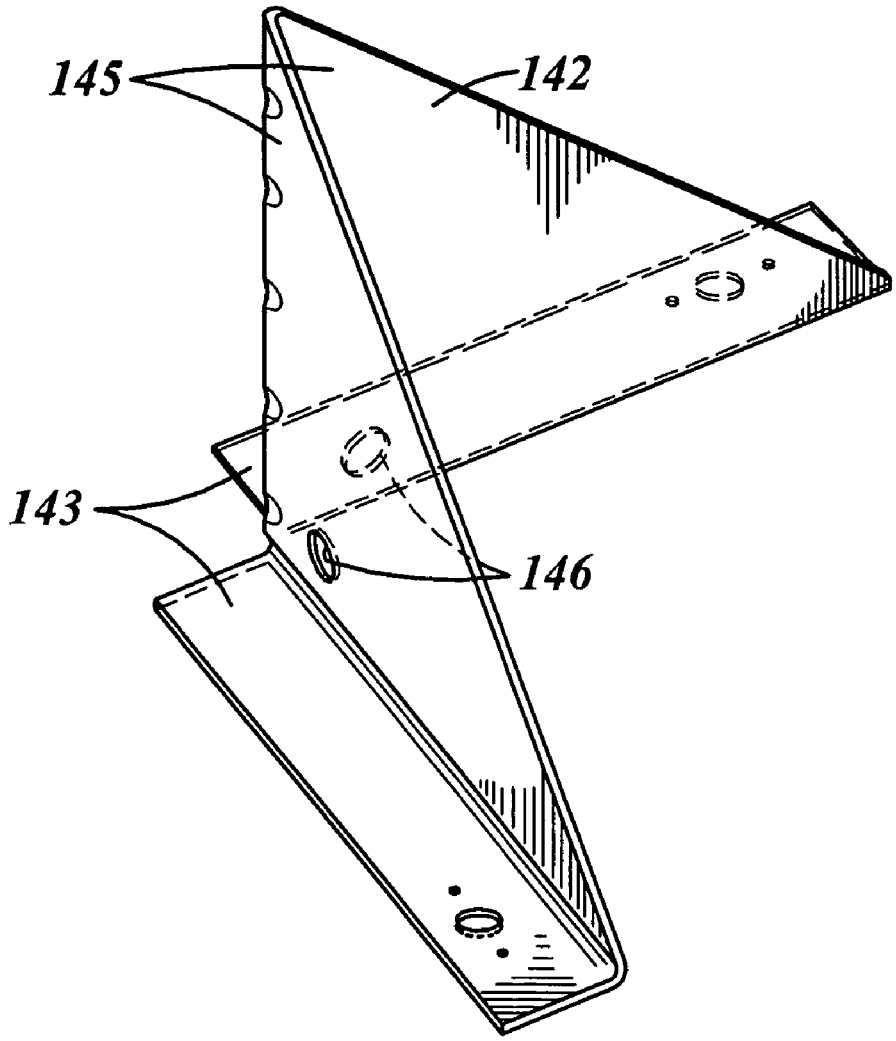
FIG. 3B is a perspective view of an inner portion of a corner bracket of the frame of FIG. 1.
Figure 3C:
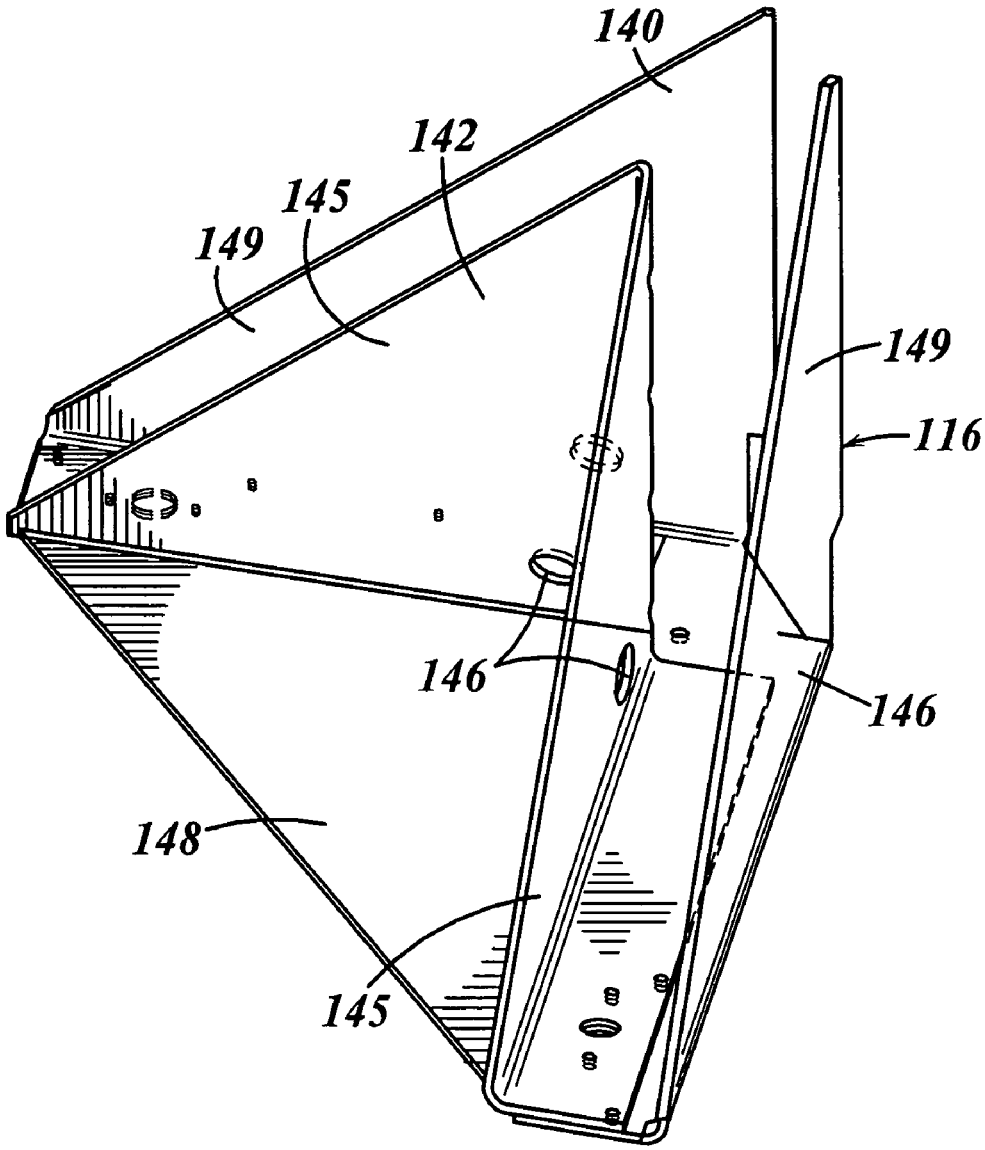
FIG. 3C is a perspective view of a partially assembled corner bracket of the frame of FIG. 1.
Figure 3D:
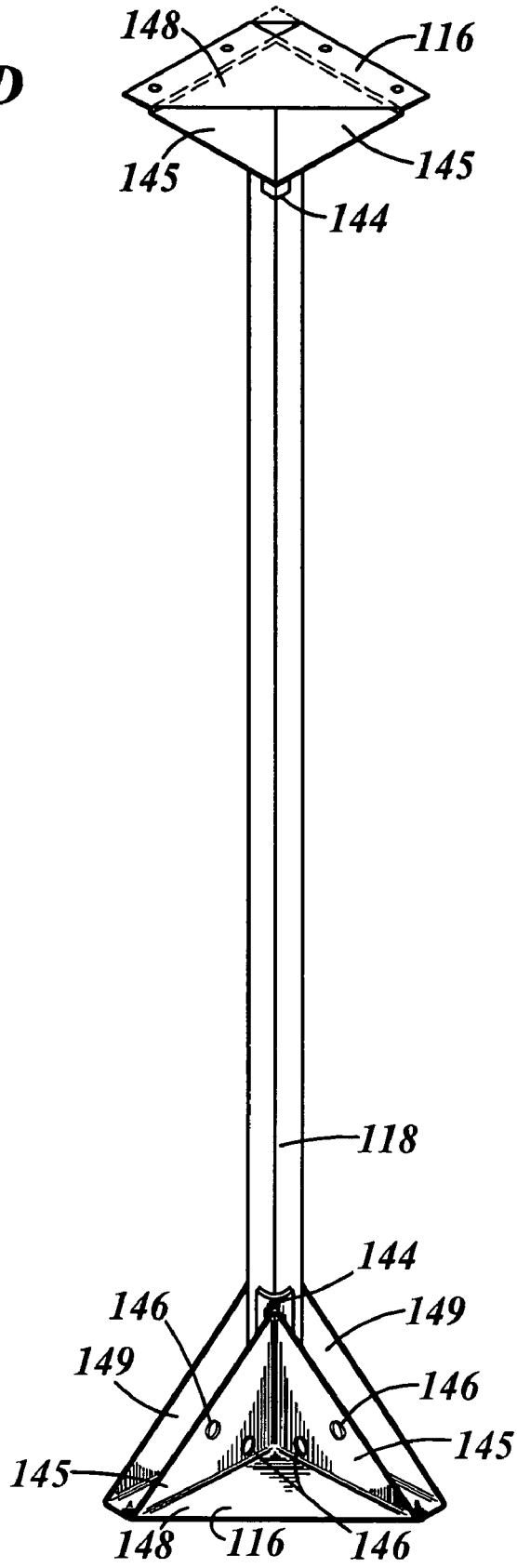
FIG. 3D is a perspective view of two partially assembled corner brackets secured to a vertical bar of a frame of the restraining enclosure of FIG. 1.
Figure 3E:
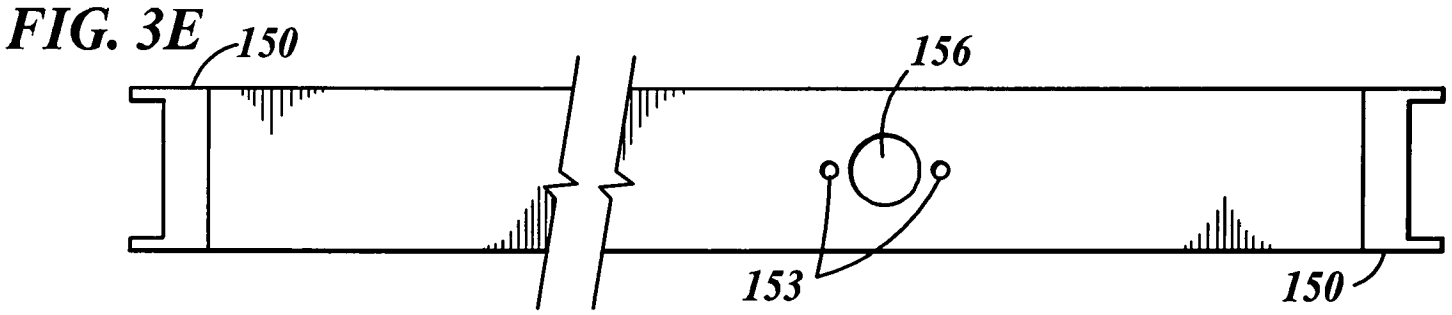
FIG. 3E is a top view of an end of a support of the frame of FIG. 1.
Figure 3F:
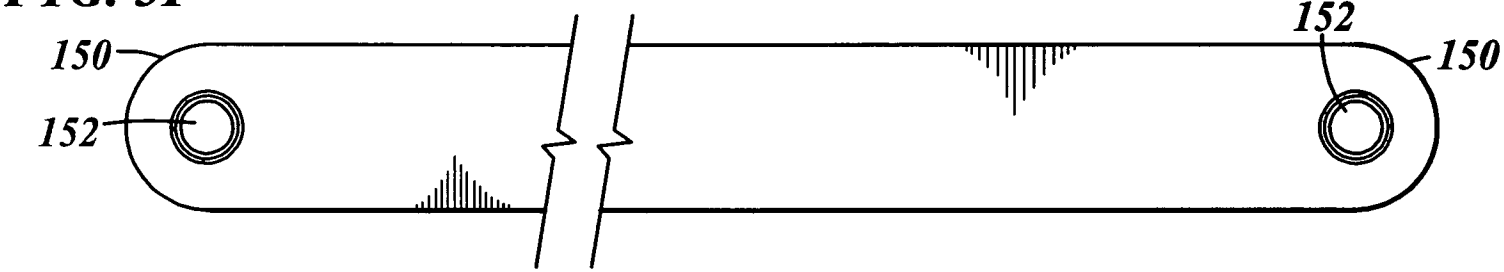
FIG. 3F is a bottom view of an end of a support of the frame of FIG. 1.
Figure 3G:
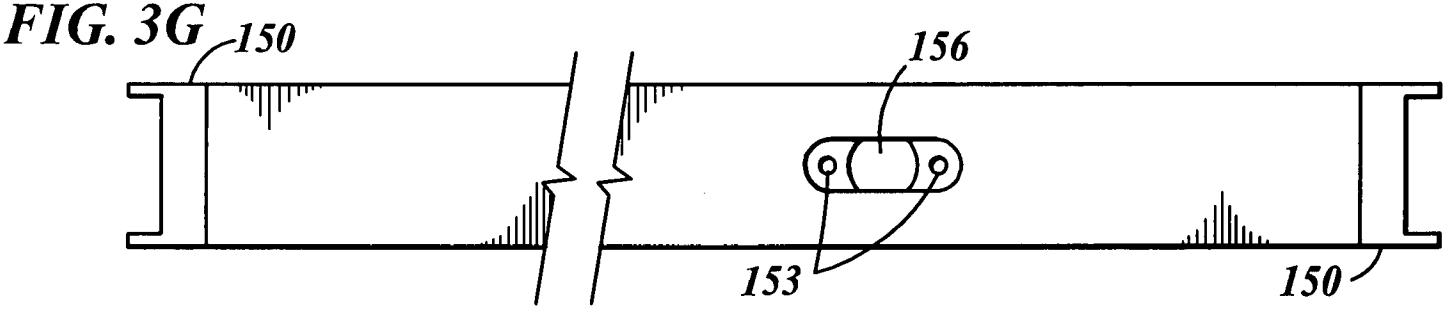
FIG. 3G is a side view of an end of a support of the frame of FIG. 1.
Figure 3H:
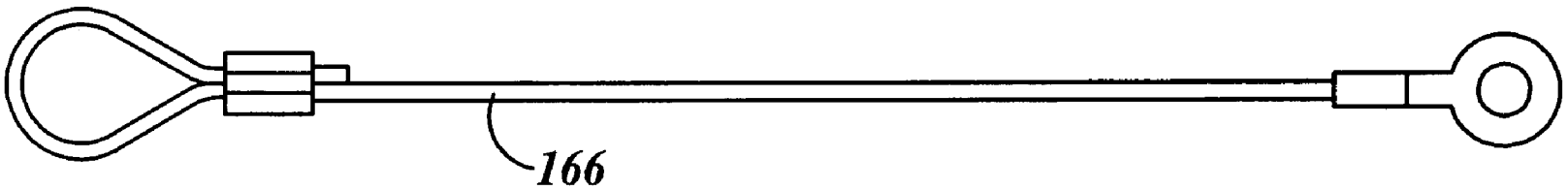
FIG. 3H is a perspective view of a tether of the restraining enclosure of FIG. 1.
Figure 3K:
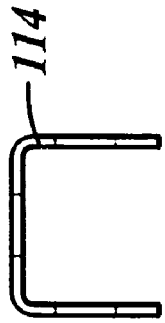
FIG. 3K is an end view of a coupling of the frame of FIG. 1.
Figure 3I:
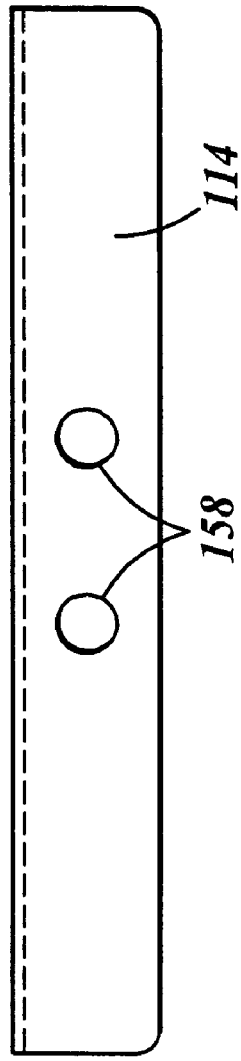
FIG. 3I is a top view of a coupling of the frame of FIG. 1.
Figure 3J:
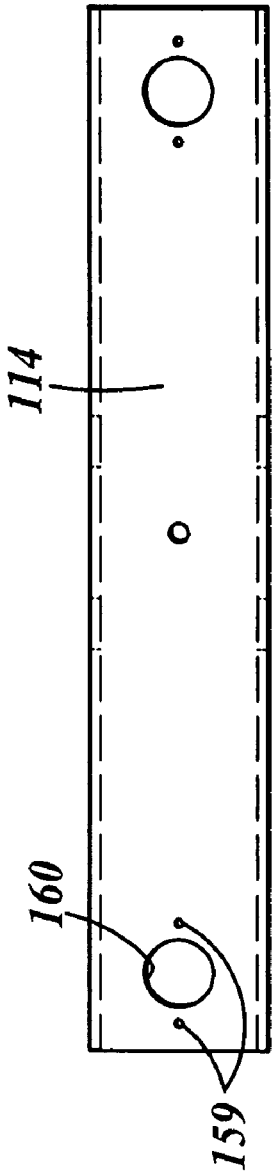
FIG. 3J is a side end view of a coupling of the frame of FIG. 1.
Figure 3L:
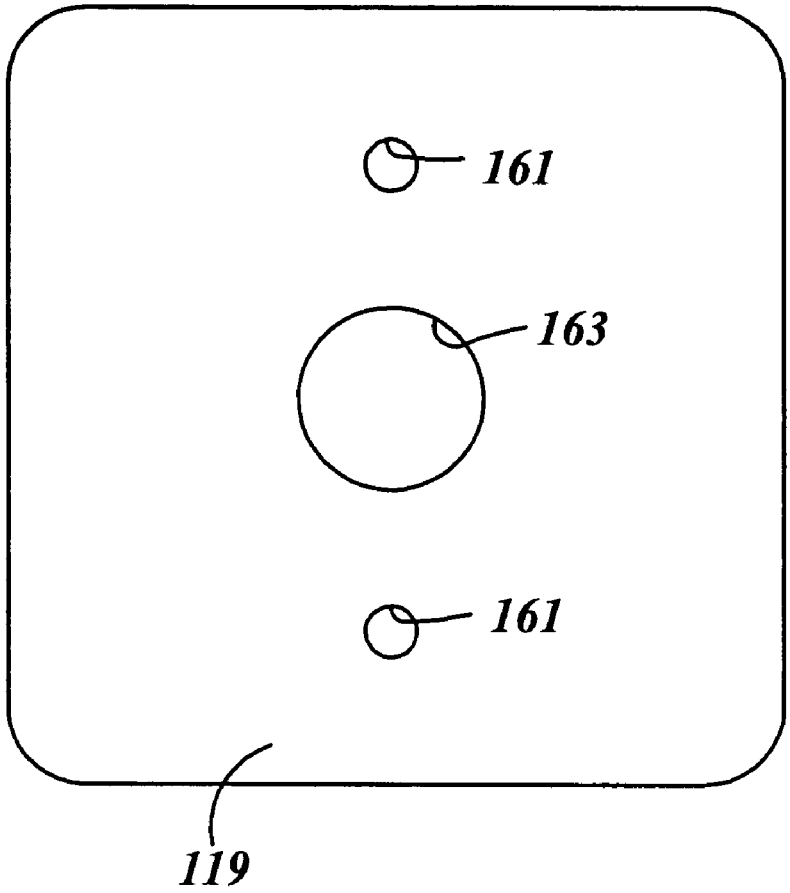
FIG. 3L is a plan view of a nut plate of the frame of FIG. 1.

Referring now to FIGS. 3E through 3H, the ends 150 of the supports 115, 117, 121, 123 (FIG. 2A) of the base portion 113 and eave portion 111 rotatably couple to the corner brackets 116. With respect to FIG. 3F, the ends 150 of the supports preferably are rounded and define a pivot passage 152 for receiving a pin (not shown). The pin also extends through holes 146 (FIGS. 3A-3D) formed in the corner brackets 116. The pin may be held in place by a cotter pin and the like and secured to the frame 110 by a nylon coated stainless steel tether 166 as shown in FIG. 3H. In one embodiment, a teflon bushing is inserted in the pivot passage 152 to enhance the smooth rotation and wear characteristics. A locking fastener (not shown) such as a captive screw secures the supports 115, 117, 121, 123 rigidly to the corner brackets 116 for assembly. Preferably, the locking fastener extends through aligned holes (not shown) in the supports 115, 117, 121, 123 and corresponding corner brackets 116. The aligned holes may be threaded or a nut and bolt combination may be used to fix the supports 115, 117, 121, 123.

Referring to FIGS. 3E through 3L, couplings 114 selectively rotatably or rigidly secure together the intermediate ends of the supports 115, 117, 121, 123. A pivot pin (not shown) rotatably secures the intermediate ends 150 of the supports 115, 117, 121, 123 to the couplings 114 by extending through holes 152 in the supports 115, 117, 121, 123 and openings 158 in the couplings 114. To fix the supports 115, 117, 121, 123 rigidly, a pin and fasteners (not shown) extend through holes 159, 160 of the coupling 114 (FIG. 3J), respectively, into holes 153, 156 respectively, of the supports 115, 117, 121, 123 (FIGS. 3E and 3G). Preferably, a pair of nut plates 119 spreads the connection force over an area of the supports 115, 117, 121, 123. For example, the pins extend into openings 163 on the nut plates 119, and the nut plates 119 are held in place about each side of the channel 156 of end 150 by the fasteners which pass through holes 161 of one of the nut plates 119 and thread into the opposing nut plate 119 by corresponding holes 161. Preferably, the pins and fasteners have locking rings to facilitate captive engagement with the nut plates 119 to prevent loss when disassembled and to provide efficient storage thereof. In another embodiment, teflon bushings (not shown) are pressed into the central openings 156 to alleviate the need for exceptionally tight tolerancing for a snug fit.

Figure 4:
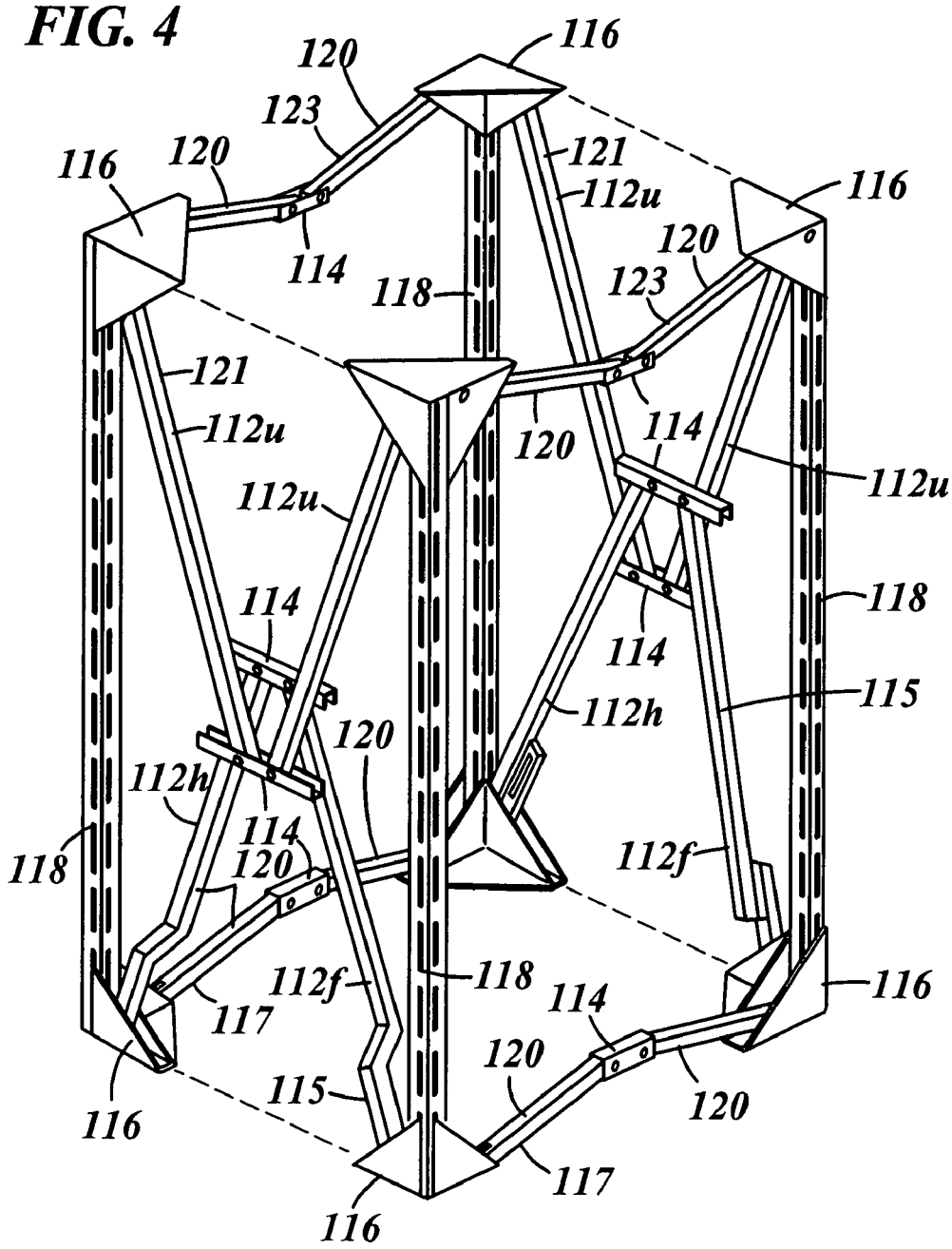
FIG. 4 is a perspective view of the frame of FIG. 1 in a partially collapsed state.
Figure 5:
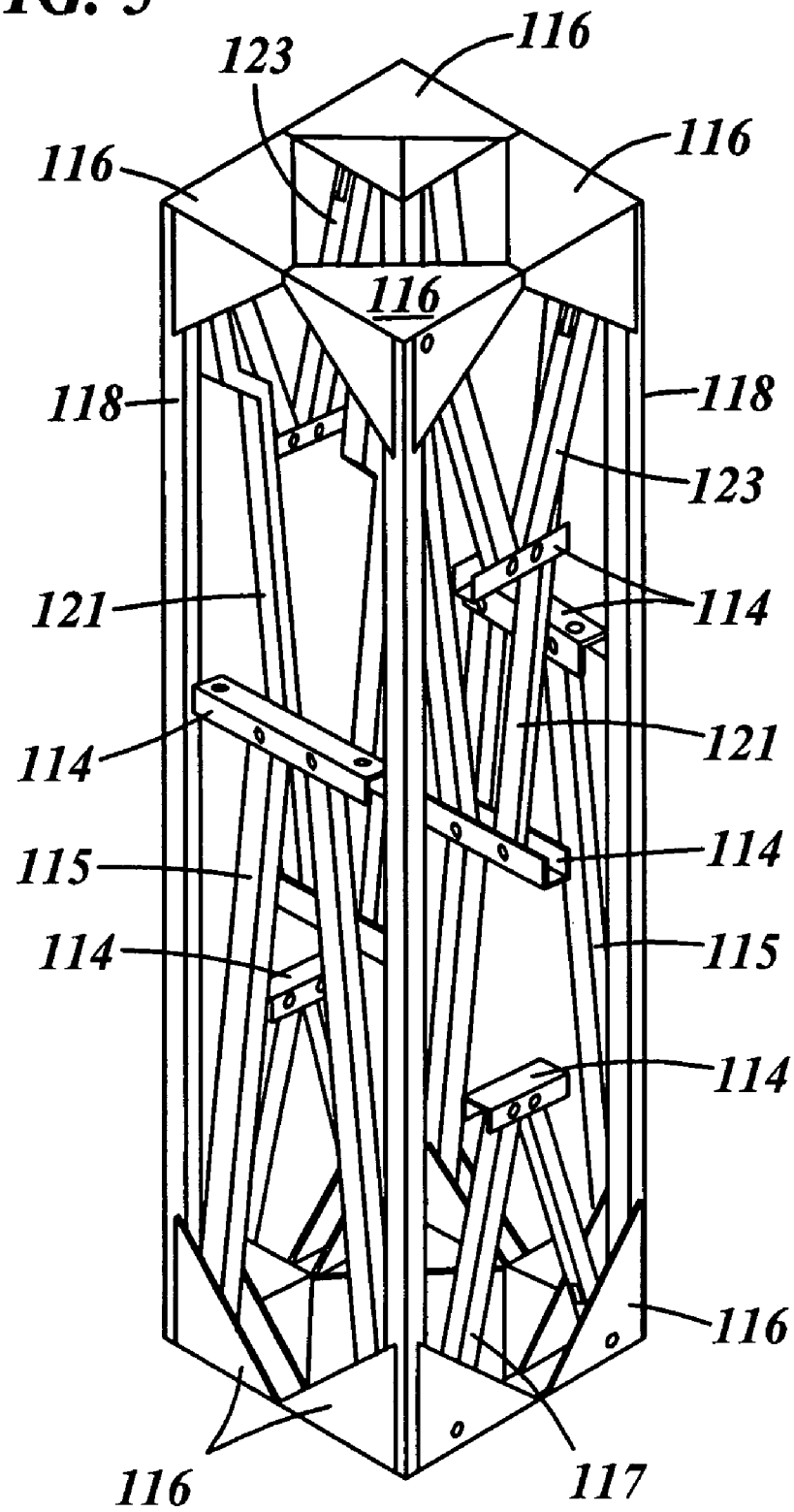
FIG. 5 is a perspective view of the frame of FIG. 1 in a fully collapsed state.
Figure 5A:
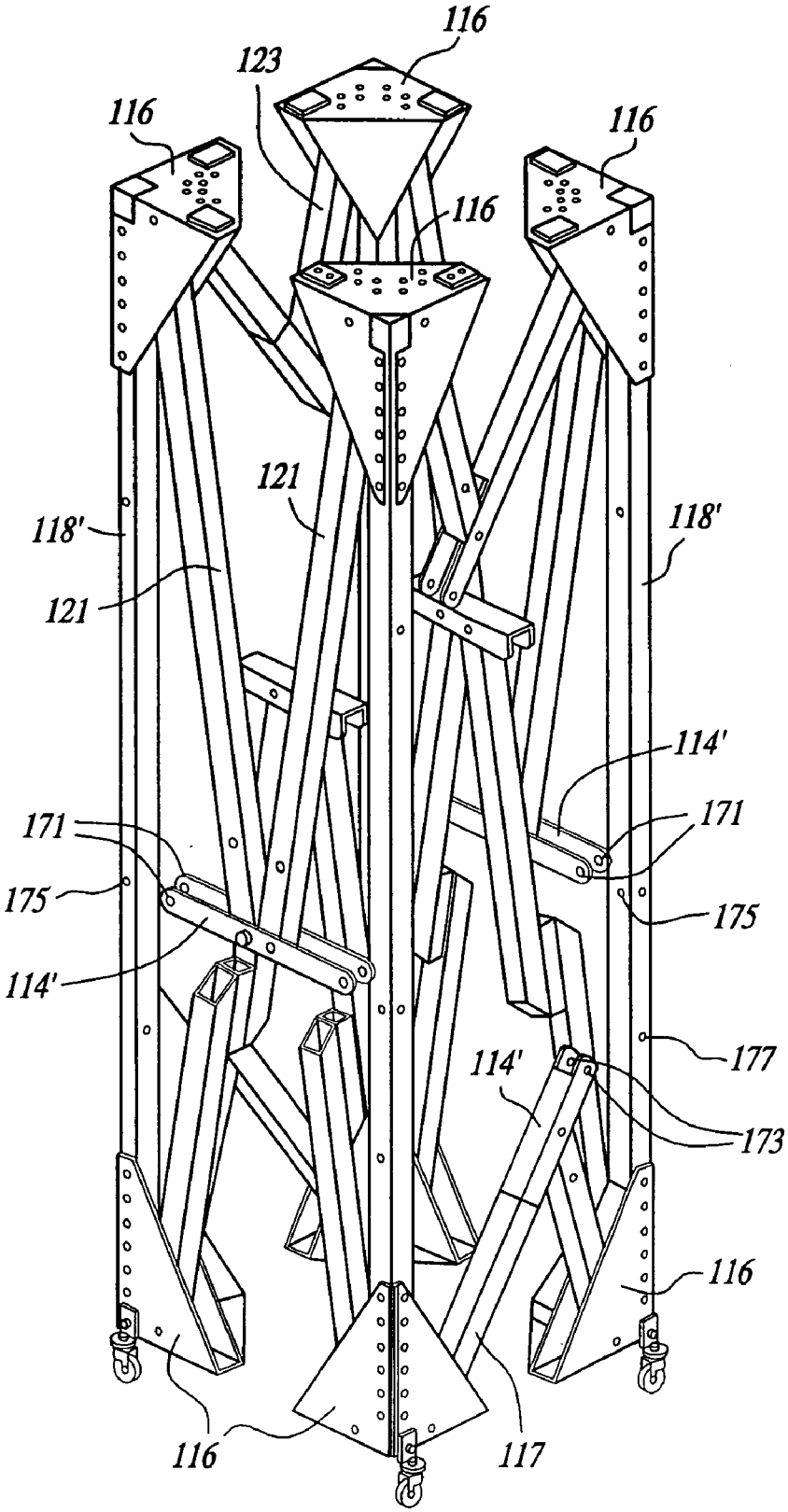
FIG. 5A is a perspective view of another embodiment of a collapsible frame of the present invention including alignable apertures and quick-connect fasteners tethered to the frame and receivable within the aligned apertures to lock the frame in a collapsed or minimized position.
Figure 5B:
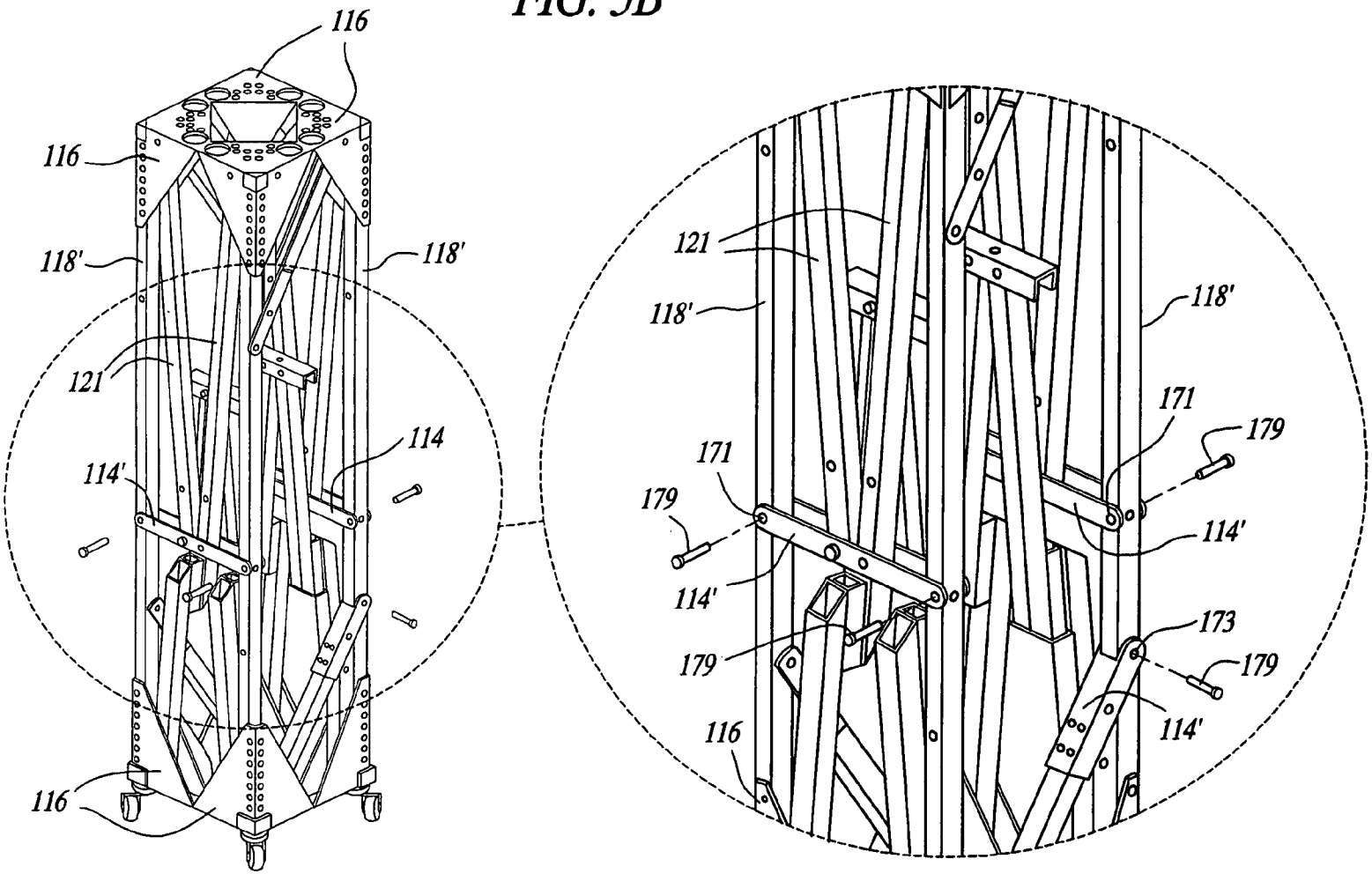
FIG. 5B is a partial, perspective view of the frame of FIG. 5A illustrating the insertion paths of the quick-connect fasteners for locking the frame in the collapsed position.

Referring to FIGS. 4 and 5, the corner brackets 116 and the couplings 114 of the frame 110 have been released to allow collapsing the frame 110 for transportation and storage. Upon release, the four vertical bars 118 remain upright and are brought together. As the four vertical bars 118 are brought together, each of the supports 115, 117, 121, 123 pivotally hinges at the respective corner bracket 116 on one end and at the respective coupling 114 on the inner end. The height of the four bars 118 is selected such that the inner ends of the transverse supports 123 of the eave portion 111 and the inner ends of the transverse supports 117 of the base portion 113 do not overlap. However, the inner ends of the elongated supports 121 of the eave portion 111 and the inner ends of the elongated supports 115 of the base portion 113 do overlap. To accommodate the overlap, the nonlinear shape of the elongated support members 115 of the base portion 113 prevent interference between the central region of the eave portion's elongated supports 121 and the base portion's elongated supports 115 when fully collapsed. As a result, the frame 110 can be minimized for storage and transport as shown in FIG. 5. Preferably, a strap (not shown), attached to the frame 110, is used to secure the frame 110 in the minimized position. In another embodiment, the collapsed frame 110 is stored within a transport bag. In still another embodiment illustrated in FIGS. 5A and 5B, the couplings 114' of the upper supports 121 define aligned pairs of first apertures 171 on opposite ends thereof, and the couplings 114' of the lower supports 123 each define an aligned pair of second apertures 173 on one end thereof. The upstanding supports 118 each define third apertures 175 extending through the mid-portions thereof, and define fourth apertures 177 angularly spaced about 90° relative to each other, and axially spaced about mid-way between the respective third apertures 175 and base support 116. As shown in FIG. 5B, when located in the fully-collapsed condition, the first apertures 171 are aligned with the third apertures 175, the second apertures 173 are aligned with the fourth apertures 177, and fasteners 179 are receivable through the aligned apertures to lock the frame in the collapsed condition. The illustrated fasteners 179 are quick-connect pins of a type known to those of ordinary skill in the pertinent art that are tethered to the frame with, for example, tethers of the type illustrated in FIG. 3H. As may be recognized by those skilled in the pertinent art based on the teachings herein, the fasteners 179 may take the form of any of numerous different types of fasteners that are currently known, or that later become known, for performing the function of the fasteners as described herein. It also will be appreciated by those skilled in the pertinent art based upon review of the subject disclosure that the collapsible frames may be collapsed with the canopy in place.

Figure 6:
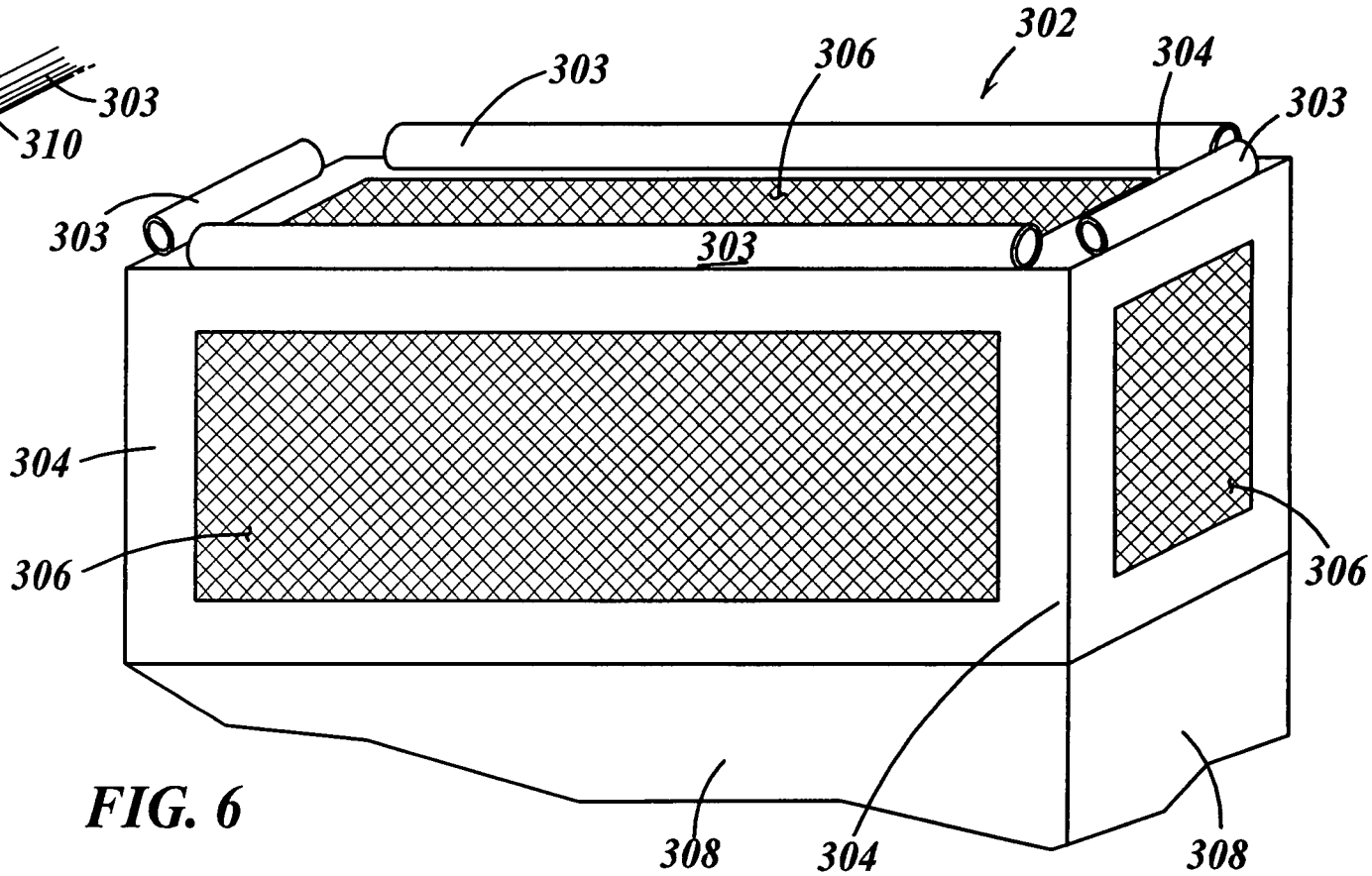
FIG. 6 is a perspective view of a canopy for another embodiment of an enclosure constructed in accordance with the present invention.
Figure 7:
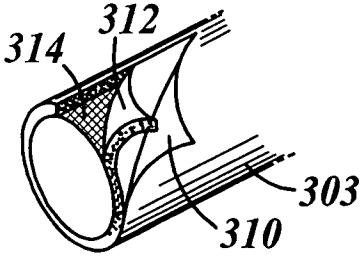
FIG. 7 is a partially disassembled view of a sleeve of the canopy of FIG. 6.

Referring to FIGS. 6 and 7, another illustrative embodiment of a canopy for an enclosure of the present invention is indicated generally by the reference numeral 302. The canopy 302 is similar to the canopy 102 described above, and therefore like reference numerals preceded by the numeral "3" instead of the numeral "1" are used to indicate like elements. Thus, the mesh or netting 306 is sized and colored (i.e., a dark colored mesh defining a color selected from the group including black, blue and brown) for enhanced see-through capability and stain resistance as described above, and to prevent unwanted objects or articles, such as a patient's fingers, from passing therethrough. The canopy 302 drapes down from the eave portion 111 of the frame 110 (FIG. 2A) by sleeves 303. The canopy 302 leaves access to a portion of the bed for adjusting the bed. Preferably, the canopy 302 has zippers (not shown) in lower panels 308 to provide such access as would be well within the skill of one in the pertinent art. As shown typically in FIG. 3, the sleeves 303 are fabricated from a combination of nylon 310, foam 312 and mesh 314. The foam 312 acts as padding for the frame 110. In a preferred embodiment, the foam 312 is a closed cell padding material to prevent water absorption and the mesh 314 allows water drainage and drying after the canopy 302 has been washed. As shown typically in FIG. 7, each sleeve 303 defines an axially-elongated seam to facilitate attachment of the sleeve to a respective support 112 or 120 of the frame 110 (FIG. 2A). As is understood by those or ordinary skill in the pertinent art based on the teachings herein, each seam may include any of numerous different devices that are currently known, or that later become known for securing the sleeve in a closed position over the respective frame support, such as a zipper, or a hook and loop (Velcro™) device. In another embodiment, sleeves are provided for securing the canopy 302 to the vertical bars 118 of the frame 110 as well.

Figures 8A, 8B:
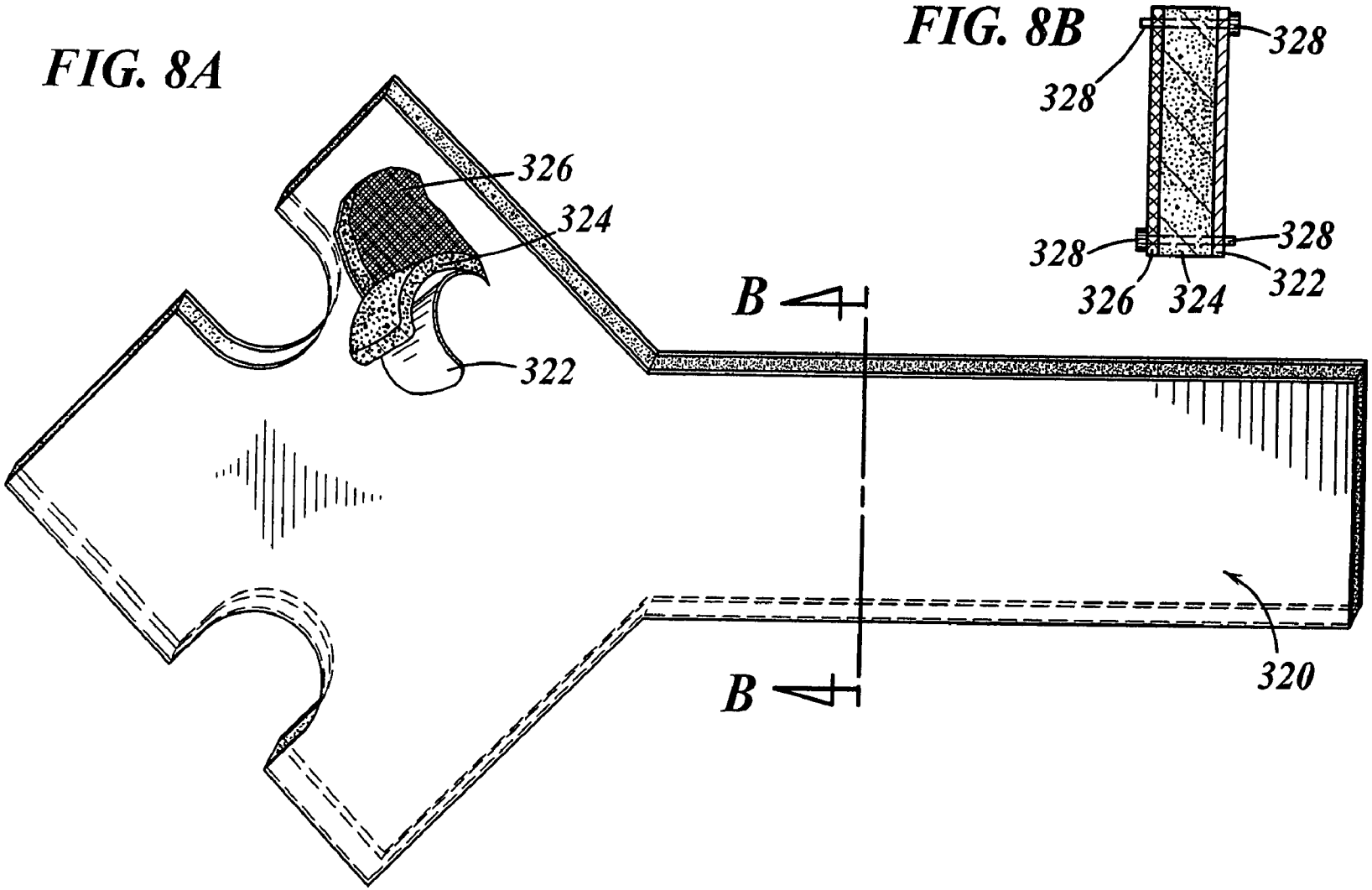
FIG. 8A is a partially disassembled view of an exemplary collar assembly for use with the canopy of FIG. 6.
FIG. 8B is a cross-sectional view of the collar assembly of FIG. 8A taken along line B-B.

Referring to FIGS. 8A and 8B, a collar assembly 320 is fitted to each vertical bar 118 (FIG. 2A) to prevent injury to the restrained patient. Additional collar assemblies 320 may be fitted and used to cover any portion of the frame which may pose potential for injury to a patient. The collar assemblies are also composed of nylon 322, foam 324, mesh 326 and fasteners 328 to allow for easy maintenance, assembly and protection of the patient from injury against the frame 110. The collar assemblies 320 are contoured for snugly and aesthetically fitting against the frame 110. The fasteners 328 are used to insure a snug fit of the collar assemblies 320 onto the frame 110. Preferably, the fasteners 328 are hook and loop fabric pairs.

Figure 9:
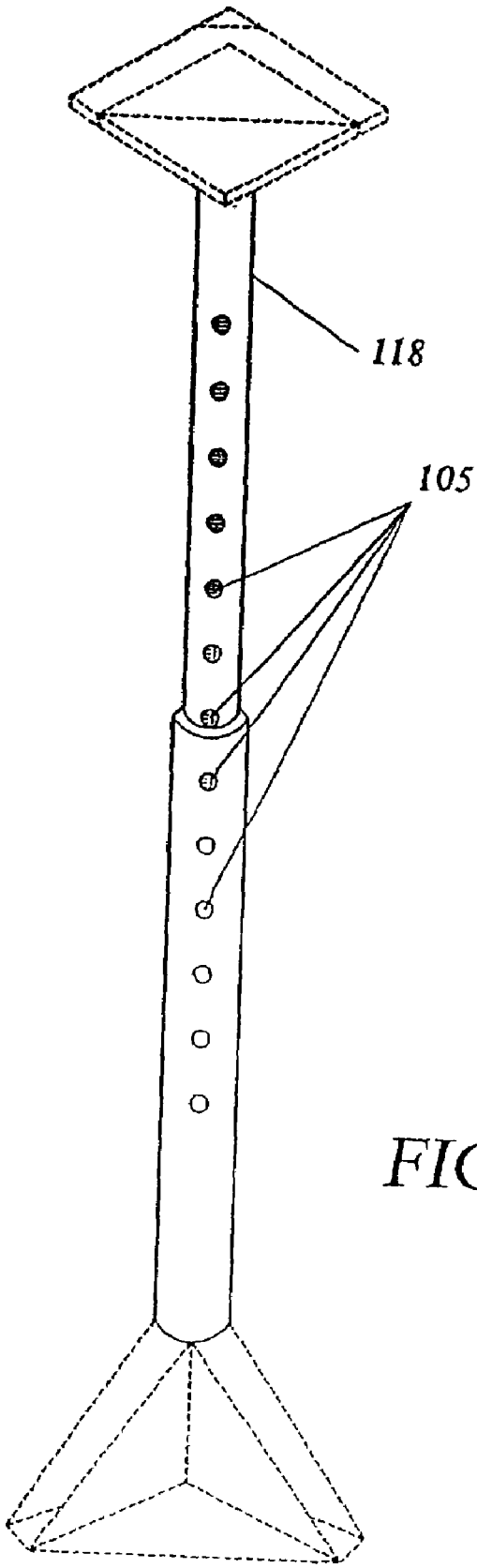
FIG. 9 is a perspective view of an exemplary frame support having telescopic characteristics.

As will be recognized by those or ordinary skill in the pertinent art based on the teachings herein, the canopies of the present invention are usable with any of numerous different types of frames that are currently known, or that later become known. For example, the canopies may be used with frames that are not collapsible, frames that collapse in a different manner than the frame 110 as described above, or frames that are adjustable in size. For example, as shown in FIG. 9, one or more supports 118 of the frame may be telescopic with securing elements 105 for enabling the frame to be adjustably sized as desired to accommodate different sized beds (e.g., infant, toddler, twin, full, queen or king sized beds). Such telescopic supports may be employed in either a collapsible frame as described above, or in a non-collapsible frame. In addition, the canopies of the present invention equally may be usable with frames that are not foldable or otherwise collapsible, but rather are fixed in position and moved whole, or require the fixedly secured parts of the frame to be disassembled to transport or store the enclosure. Such non-collapsible frames may be mounted on the floor surrounding the bed as illustrated in FIG. 1, may be fixedly secured to the bed frame and movable therewith on, for example, casters spaced laterally from the bed, or may be mounted on the bed frame to form a combined bed and enclosure frame. Such frames also may be modular, such that separable frame modules or sub-assemblies can be disassembled from each other to transport or store the frame.

Figure 10:
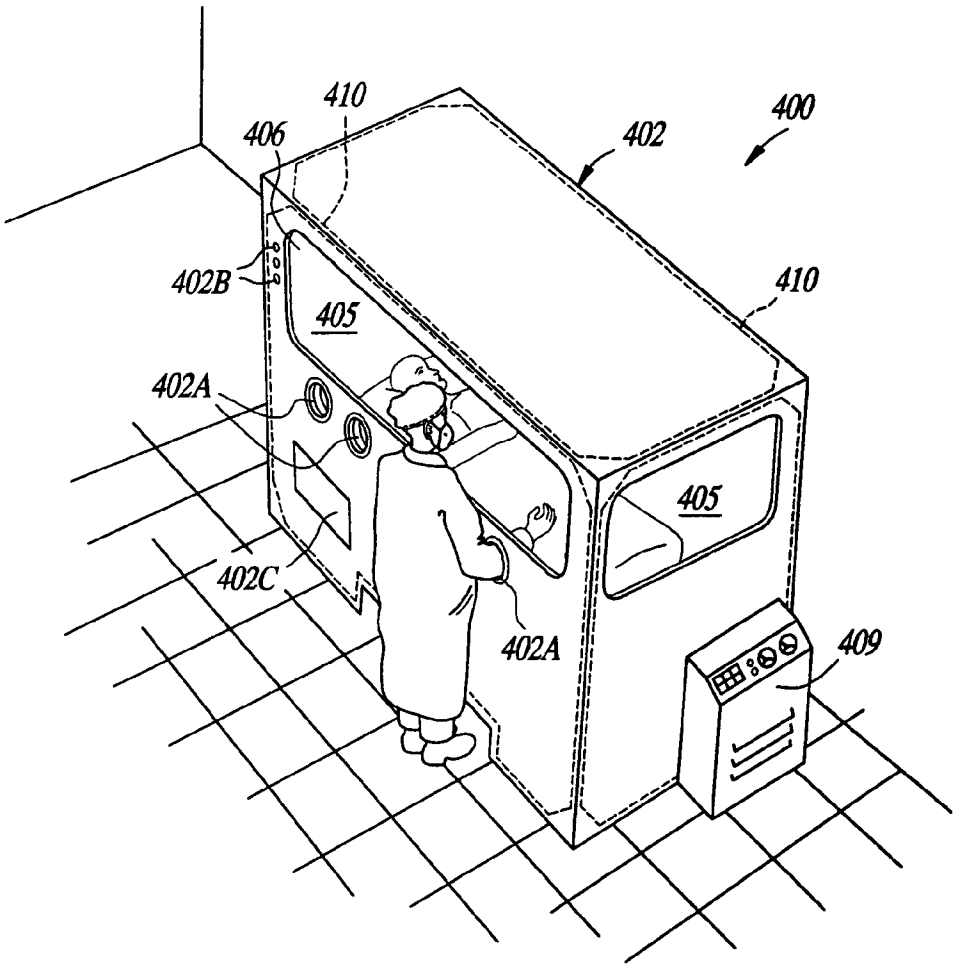
FIG. 10 is perspective view another embodiment of an enclosure of the present invention that is particularly suited for use as a quarantine enclosure or as a patient isolation unit.
Figure 11:
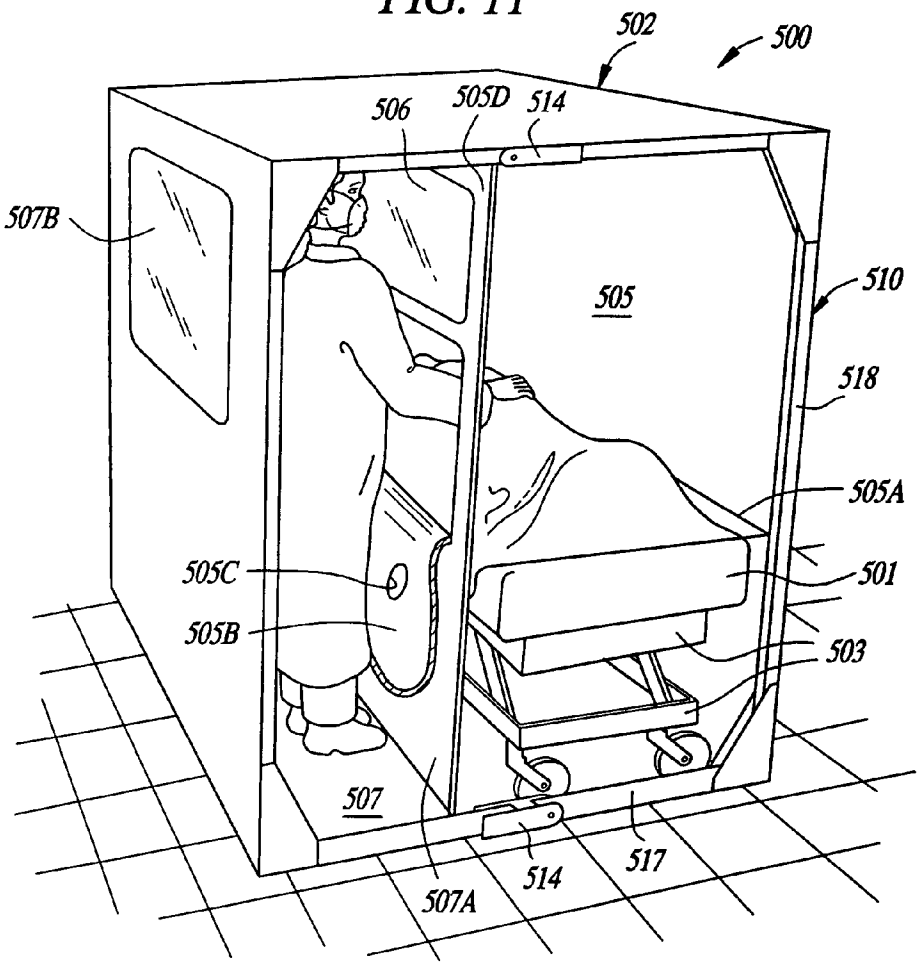
FIG. 11 is a part-sectional, perspective view of another enclosure of the present invention suited for use as a quarantine enclosure or as a patient isolation unit.
Figure 12:
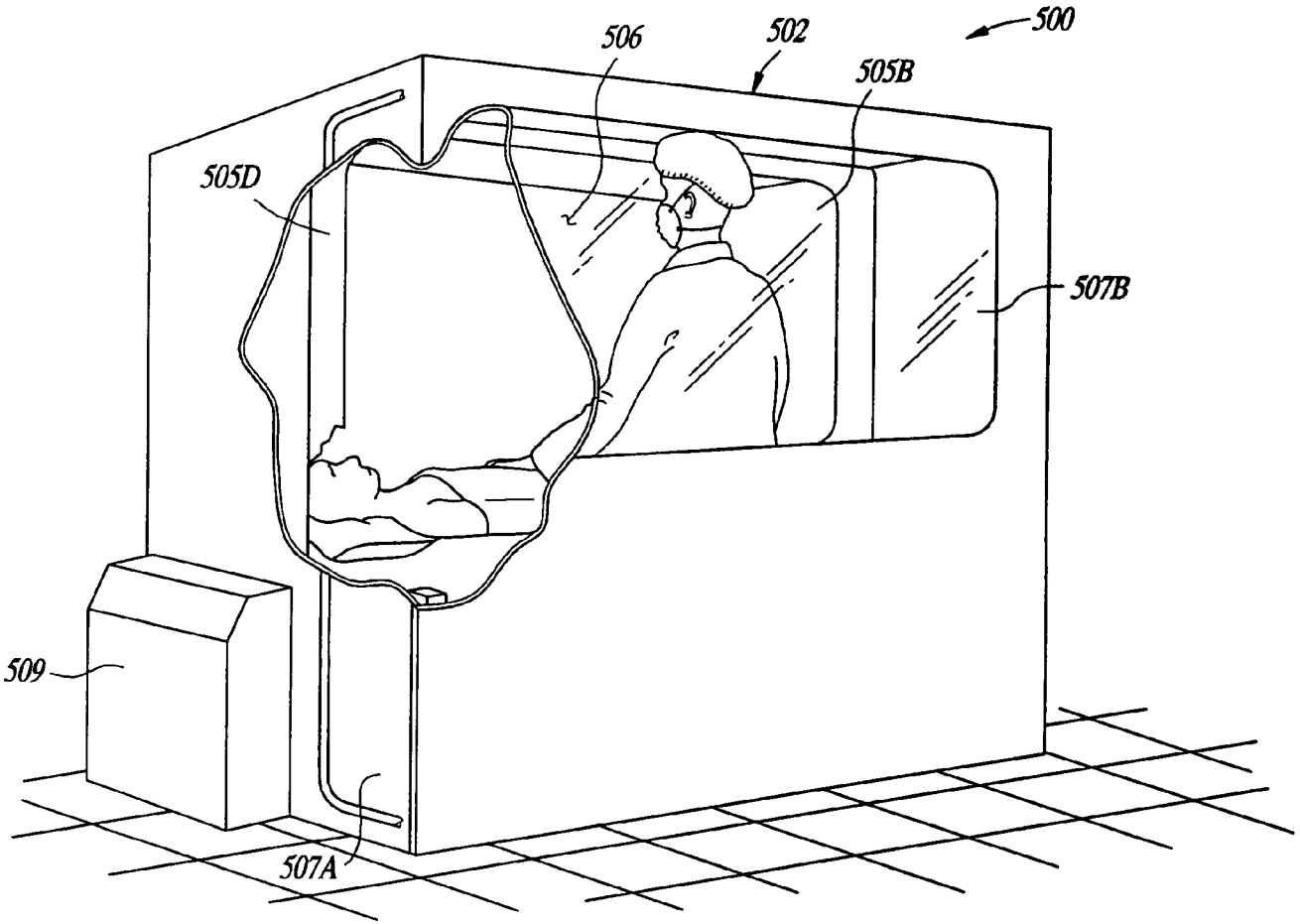
FIG. 12 is another part-sectional, perspective view of the enclosure of FIG. 11.

In FIG. 10, another embodiment of an enclosure of the present invention is indicated generally by the reference numeral 400, and in FIGS. 11 and 12, another embodiment of an enclosure of the present invention is indicated generally by the reference numeral 500. The enclosures 400 and 500 are similar in many respects to the enclosure 100 described above, and therefore like reference numerals preceded by the numeral "4" or the numeral "5", instead of the numeral "1", are used to indicate like elements. As described further below, the enclosures 400 and 500 are particularly suited for use as quarantine enclosures and/or as patient isolation units.

With reference to FIG. 10, the enclosure 400 includes a canopy 402 mounted on a frame 410 (shown somewhat schematically in broken lines). The illustrated frame 410 may be the same as the collapsible frame 110 described above. The canopy 402 may be mounted to the frame 410 in the same manner as is the canopy described above (i.e., by sleeves releasably connected to the frame supports), and when so mounted, the canopy and frame define at least one isolation chamber 405 for enclosing and confining a patient to a predefined area. One difference between the canopy 402 and the canopies 102 or 302 described above, however, is that the canopy 402 defines an isolation chamber 405 that is sealed with respect to the exterior of the canopy to quarantine or isolate the patient located within the canopy, as described further below. As can be seen, the canopy 402 defines a plurality of glove ports 402*a* to allow a physician, other care giver or individual access to the patient and/or isolation chamber 405 of the canopy, and a plurality of transparent or otherwise see-through windows 406 to allow visibility therethrough. The quarantine canopy 402 may be made of any of numerous different materials that are currently known, or that later become known for effecting a safe and effective isolation of patients with any of a variety of infectious diseases or other conditions requiring quarantining or isolation, such as vinyl or other polymeric materials. An environmental control unit 409 is mounted on the exterior of the canopy 402 and coupled in fluid communication with the interior chamber 405 to control the flow of air into and out of the chamber and to otherwise control the environmental conditions within the chamber. The quarantine canopy 402 is provided with one or more quick disconnect couplings 402*b* for the administration of IV lines and/or the like from outside the quarantine canopy 402. In addition, the quarantine canopy 402 includes one or more ports or air locks 402*c* extending through an exterior wall thereof for the passage of food, medicine, waste and/or other matter therethrough. Such ports may take the form of any of numerous different sterile transfer ports or like devices that are currently known, or that later become known for performing the function of the ports 402*c*. Such sterile transfer ports also include a UV device or other means for sterilizing any matter removed from the isolation chamber therethrough to prevent contamination outside of the chamber. Such sterilizing means may take the form of any of numerous such means that are currently known, or that later become known for performing this function.

With reference to FIGS. 11 and 12, the enclosure 500 differs from the enclosure 400 in that the canopy 502 further defines an airlock chamber 507 formed within the canopy and adjacent to the isolation chamber 505, but separable therefrom. In this embodiment, the frame 510 is at least laterally larger than the frame 410 to laterally accommodate the airlock chamber 507 adjacent to the isolation chamber 505 as illustrated.

As shown in FIG. 11, the isolation chamber 505 is preferably positioned above a patient's bed 503 so that the patient is optimally positioned for effective care and/or observation. The frame 510 and the quarantine canopy 502 preferably cooperate to allow the patient's bed 503, which may be adjustably raised and/or lowered, to be easily removed and/or replaced as needed. In the illustrated embodiment, the mattress 501 of the bed is located beneath, and outside of the isolation chamber 505 such that at least one lower wall 505*a* of the isolation chamber 505 rests on the mattress 501 when the patient's bed is in place. In an alternative embodiment, the mattress 501 may be located within the isolation chamber 505 above the patient's bed 500 with at least one lower wall 505*a* of the isolation chamber 505 located between the mattress 501 and the other portions of the bed 500. One advantage of the illustrated embodiment is that the mattress is isolated from the interior of the isolation chamber, thus preventing contamination of the mattress, or preventing the need to sterilize or otherwise clean the mattress between usages.

The isolation chamber 505 also is provided with one or more transparent portions 506 both enabling effective observation of a quarantined patient and enabling the patient to see through to the exterior of the enclosure. The transparent portions 506 may be either clear or tinted as desired and, as with the rest of the isolation chamber 505, are preferably hermetically sealed and airtight.

The isolation chamber 505 is further provided with one or more access panels 505*b* suitable to allow direct access to a quarantined patient as needed. These access panels 505*b* may be selectively opened and/or hermetically closed as needed. Also, the access panels may be provided with decontamination means, such as, for example, an ultra-violet (UV) source or a disinfecting gas source (not shown). In addition, the access panels may be transparent, semi-transparent, may include a dark-colored mesh overlay, layer or other mesh portion to prevent glare when looking through such panels, may be opaque, or any desired combination of the foregoing.

The isolation chamber 505 also includes one or more access glove ports 505*c*, best shown in FIG. 11, to facilitate indirect interaction with the quarantined patient. The access glove ports 505*c* may be formed through the access panels 505*b*, as shown, or otherwise may extend through an exterior wall defining the isolation chamber 505. The access glove ports 505*c* also may be provided with suitable decontamination means as appropriate for different applications.

The airlock chamber 507 extends laterally adjacent to the isolation chamber 505 and extends the full length (or width) of the frame. The airlock chamber 507 may be provided with one or more ingress/egress openings 507*a*. The ingress/egress openings 507*a* preferably allow access to the airlock chamber 507. The ingress/egress openings 507*a* of the airlock chamber 507, similar to the access panels 505*b* of the isolation chamber 505, may be selectively opened and/or hermetically closed as needed, and may include decontamination means (not shown) to enable a person to safely enter and/or exit the airlock chamber 507. The airlock chamber 507 may be provided with one or more windows 507*b*, which may be substantially similar to the transparent portions 506 of the isolation chamber 505. The airlock chamber 507 is preferably located adjacent to the isolation chamber 505 and separated therefrom by at least one partition or side wall 505*d* that extends vertically between the upper and lower portions of the frame. As indicated above, both the airlock chamber 507 and isolation chamber 505 are formed integral with each other within the canopy 502 and are supported by a common frame 510. The canopy 502 may be mounted on the frame 510 in the same manner as the canopy 102 described above (i.e., by sleeves releasably connected to the upper supports of the frame). In addition, the frame 510 may be the same as the frame 110 described above, or may be a different type of frame, such as a non-collapsible frame or a frame with telescoping supports for adjusting the size of the enclosure. In addition, as may be recognized by those of ordinary skill in the pertinent art based on the teachings herein, the airlock chamber 507 may be separably connected to the isolation chamber 505 and/or may have a separate frame (not shown) associated therewith that may be separably connected to the frame 510.

In accordance with one aspect of the present embodiment, the windows 507*b*, the access panels 505*b*, the ingress/egress openings 507*a*, and/or the transparent portions 506 each may have one or more layers associated therewith. For example, each of the foregoing features of the present embodiment may be provided with at least one opaque layer, at least one tinted layer, and/or at least one clear layer. This multi-layered arrangement could, for instance, be utilized to control the degree of visibility into the chamber and/or the amount of ambient light that is allowed into the chamber. Further, one or more of the windows may include a dark-colored mesh layer as described above in connection with the canopies 102 and 302 so that the other layer(s) can be removed or folded downwardly to thereby leave only the mesh layer within the window. In this case, the canopy would be used as a restraining enclosure, but not as a quarantine enclosure. Alternatively, the mesh layer may be used with the transparent or semi-transparent layer(s) to prevent glare as described above.

The environmental control system 509 preferably includes at least one air pump, a HEPA or other suitable filtration system, and one or more one-way air-ingress ports connected in fluid communication with the isolation chamber 505 and airlock chamber 507. The environmental control system 509 is preferably portably compact and relatively lightweight for easy mobility. The environmental control system 509 may be selectively operatively connected to the isolation chamber 505 and/or to the airlock chamber 507. If desired, the environmental control system 509 may be secured to the frame 510 so as to establish an efficient, effectively self-contained portable quarantine unit suitable for a variety of different quarantine applications.

As would be appreciated by those of ordinary skill in the pertinent art upon review of the subject disclosure, the figures and associated detailed description are representative of preferred embodiments and various modifications can be made thereto. While the invention has been described with respect to preferred embodiments, those skilled in the art will readily appreciate that various changes and/or modifications can be made to the invention without departing from the spirit or scope of the invention as disclosed herein and as claimed.

What is claimed is:

1. An enclosure for patient care for restraining a patient to an area about a bed, wherein the bed is adapted to support the patient, comprising:

a frame adapted to surround the bed, the frame including an upper laterally extending support and at least one upstanding support;

a canopy supportable by the frame for defining an area about the bed such that a patient is allowed to move freely within the area, the canopy including at least one access portion movable between a closed position and an open position and defining an opening through the canopy for allowing access to the patient area, and at least one see-through portion defined by a mesh that prevents glare and permits visual monitoring of the patient area from outside of the canopy; and a mounting sleeve defining an axially-extending seam having an open position for receiving a portion of the frame and a closed position for securing the canopy to the portion of the frame, and including a fastener for maintaining the seam in the closed position.

2. An enclosure as defined in claim 1, wherein the frame is foldable and collapsible from an open position to a closed position.

3. An enclosure as defined in claim 1, wherein the color of the mesh is black, brown or blue.

4. An enclosure as defined in claim 1, wherein the mesh is a dark colored mesh.

5. An enclosure as defined in claim 1, wherein the at least one upstanding support comprises a first upstanding support coupled to a first side of the upper laterally extending support and a second upstanding support coupled to a second side of the upper laterally extending support.

6. An enclosure as defined in claim 5, wherein at least one of the upper laterally extending support and the first and second upstanding supports is telescopic.

7. An enclosure as defined in claim 6, wherein the mounting sleeve includes a plurality of layers.

8. An enclosure as defined in claim 7, wherein the plurality of layers includes an inner mesh layer, an intermediate cushioning layer, and an outer resilient layer.

9. An enclosure as defined in claim 6, wherein the canopy further includes at least one collar for mounting the canopy to at least one of the first and second upstanding supports.

10. An enclosure as defined in claim 9, wherein at least one of the collars includes a plurality of material layers.

11. An enclosure as defined in claim 10, wherein the material layers include an inner mesh layer, an intermediate cushioning layer, and an outer resilient layer.

12. An enclosure for patient care for restraining a patient to an area about a bed, wherein the bed is adapted to support the patient, comprising:

a frame adapted to surround the bed, the frame including:

an upper laterally extending support;

a first upstanding support coupled to a first side of the upper laterally extending support; and a second upstanding support coupled to a second side of the upper laterally extending support;

a canopy connectable to the frame for defining an area about the bed such that a patient is allowed to move freely within the area, and including at least one access portion movable between a closed position and an open position defining an opening through the canopy for allowing access to the patient area;

at least one see-through portion defined by a mesh for permitting visual monitoring of the patient area from outside of the canopy; and at least one mounting sleeve defining an axially-extending seam for supporting the canopy on the upper laterally extending support, wherein the mounting sleeve includes a plurality of layers including an inner mesh layer, an intermediate cushioning layer, and an outer resilient layer.

13. A method for patient care for restraining a patient to an area about a bed adapted to support the patient, the method comprising the steps of:

providing a frame adapted to surround the bed, the frame including an upper laterally extending support and at least one upstanding support;

providing a canopy supportable by the frame;

providing a mounting sleeve defining an axially-extending seam having an open position for receiving a portion of the frame and a closed position for securing the canopy to the portion of the frame, and including a fastener for maintaining the seam in the closed position;

securing the canopy to the frame via the mounting sleeve;

surrounding the bed with the canopy supported on the frame and defining an area within the canopy and about the bed within which the patient is allowed to move freely;

allowing access to the patient through a portion of the canopy that is movable between an open and a closed position;

allowing visual monitoring through at least one see-through portion of the canopy; and preventing glare through and around the see-through portion by forming a netting defining a dark-colored mesh.

14. A method as recited in claim 13, wherein the frame is foldable and collapsible from an open position to a closed position.

15. An enclosure as defined in claim 13, further comprising the step of visually monitoring the patient from outside of the canopy through the at least one see-through portion of the canopy.

16. An enclosure for patient care for restraining a patient to an area about a bed, wherein the bed is adapted to support the patient comprising:

a frame adapted to surround the bed, the frame including an upper laterally extending support and at least one upstanding support;

a canopy supportable by the frame;

a mounting sleeve defining an axially-extending seam having an open position for receiving a portion of the frame and a closed position for securing the canopy to the portion of the frame, and including a fastener for maintaining the seam in the closed position;

first means for defining an area about the bed such that a patient is allowed to move freely within the area; and second means for forming an opening through the first means and allowing access to the patient area therethrough, and including third means for preventing glare and permitting visual monitoring of the patient through the second means and into the patient area from outside of the canopy.

17. An enclosure as defined in claim 16, wherein the third means is a dark-colored mesh.

18. An enclosure as defined in claim 17, wherein the color of the mesh is black, brown or blue.

19. An enclosure as defined in claim 16, wherein the first means is a plurality of side walls of the canopy.

20. An enclosure as defined in claim 16, wherein the second means is an access portion movable between a closed position and an open position.

21. An enclosure for patient care to restrain a patient to an area about a bed, wherein the bed is adapted to support the patient, comprising:

a frame adapted to surround the bed, the frame including:

an upper laterally extending support;

a first upstanding support coupled to a first side of the upper laterally extending support; and a second upstanding support coupled to a second side of the upper laterally extending support;

a canopy connectable to the frame for defining an area about the bed such that a patient is allowed to move freely within the area, and including at least one access portion movable between a closed position and an open position defining an opening through the canopy for allowing access to the patient area; at least one see-through portion defined by a mesh that prevents glare and permits visual monitoring of the patient area from outside of the canopy; and at least one padded mounting sleeve for securing the canopy to the frame, the at least one mounting sleeve defining an axially-extending seam having an open position for receiving a portion of the frame and a closed position for securing the sleeve to the portion of the frame, wherein the axially-extending seam includes a mechanical fastener for securing the at least one sleeve in the closed position.

22. An enclosure as defined in claim 21, wherein the mechanical connection is a zipper, a button fastener, snap fastener or hook and loop fastener.

23. An enclosure as defined in claim 21, further comprising at least one collar assembly for mounting the canopy to at least one of the first and second upstanding supports.

* * * * *

UNITED STATES PATENT AND TRADEMARK OFFICE

CERTIFICATE OF CORRECTION

PATENT NO. : 7,380,296 B2
APPLICATION NO. : 10/910939
DATED : June 3, 2008
INVENTOR(S) : Thomas D. Ellen and John J. Gildea It is certified that error appears in the above-identified patent and that said Letters Patent is hereby corrected as shown below:

Title page, item [73] Assignee, delete "Vival" and insert --Vivax--

Signed and Sealed this

Eighteenth Day of November, 2008

JON W. DUDAS
*Director of the United States Patent and Trademark Office*